US006887656B2

(12) United States Patent
Friedrich et al.

(10) Patent No.: US 6,887,656 B2
(45) Date of Patent: May 3, 2005

(54) COLOR PHOTOGRAPHIC ELEMENT CONTAINING IMPROVED HETEROCYCLIC SPEED ENHANCING COMPOUND

(75) Inventors: Louis E. Friedrich, Rochester, NY (US); Philip A. Allway, Rickmansworth (GB); Judith A. Bogie, Watford (GB); Bernard A. Clark, Maidenhead (GB); Charles E. Heckler, W. Henrietta, NY (US); Stephen P. Singer, Spencerport, NY (US)

(73) Assignee: Eastman Kodak Company, Rochester, NY (US)

( * ) Notice: Subject to any disclaimer, the term of this patent is extended or adjusted under 35 U.S.C. 154(b) by 37 days.

(21) Appl. No.: 10/346,434

(22) Filed: Jan. 17, 2003

(65) Prior Publication Data

US 2004/0142289 A1 Jul. 22, 2004

(51) Int. Cl.[7] ..... G03C 1/08; G03C 7/26; G03C 7/32

(52) U.S. Cl. ..... 430/550; 430/551; 430/599; 430/600; 430/607; 430/613; 430/614; 430/615; 430/627; 430/630

(58) Field of Search ..... 430/550, 551, 430/599, 600, 607, 613–615, 627, 630

(56) References Cited

U.S. PATENT DOCUMENTS

| | | | | |
|---|---|---|---|---|
| 5,187,054 A | | 2/1993 | Dewanckele et al. | |
| 6,140,029 A | | 10/2000 | Clark et al. | |
| 6,190,848 B1 | | 2/2001 | Boff et al. | |
| 6,228,572 B1 | | 5/2001 | Vargas et al. | |
| 6,316,177 B1 | * | 11/2001 | Allway et al. | 430/550 |
| 6,319,660 B1 | | 11/2001 | Allway et al. | |
| 6,350,564 B1 | | 2/2002 | Bringley et al. | |
| 6,589,724 B1 | * | 7/2003 | Singer et al. | 430/627 |

* cited by examiner

*Primary Examiner*—Geraldine Letscher
(74) *Attorney, Agent, or Firm*—Arthur E. Kluegel

(57) ABSTRACT

Disclosed is a color photographic element comprising at least one light sensitive silver halide emulsion layer containing a compound that does not react with oxidized developer, has a Log Kow high enough to improve speed, compared to the same layer without the compound, and comprises (1) a thiadiazole, or (2) an oxadiazole, or (3) a 1,2,4 triazole bearing an amido substituent, and does not contain a hydroxyl or thiol group or their tautomeric equivalents on the azole ring.

38 Claims, No Drawings

COLOR PHOTOGRAPHIC ELEMENT CONTAINING IMPROVED HETEROCYCLIC SPEED ENHANCING COMPOUND

FIELD OF THE INVENTION

The invention is a silver halide photographic element with an addendum that provides improved speed with little or no reduction in interimage effects and with improved melt-hold stability.

BACKGROUND OF THE INVENTION

It is a long-standing objective of color photographic origination materials to maximize the overall response to light while maintaining the lowest possible granularity. Increased photographic sensitivity to light, commonly referred to as photographic speed, allows for improved images captured under low light conditions or improved details in the shadowed regions of the image. In general, the overall light sensitivity provided by the light sensitive silver halide emulsions in such systems is determined by the size of the emulsion grains. Larger emulsion grains capture more light. Upon development, the captured light is ultimately converted into dye deposits that constitute the reproduced image. However, the granularity exhibited by these dye deposits is directly proportional to the sizes of the silver halide grains. Thus, larger silver halide grains have higher sensitivity to light but also lead to higher granularity in the reproduced image. Therefore, it is a fundamental problem in photography to improve the light sensitivity of a silver halide element without changing the silver halide emulsion.

One partial solution to the problem is to coat an addendum in the film as described in U.S. Pat. No. 6,319,660. The described addenda that contain at least three heteroatoms provide speed increases, but they also degrade interimage effects thereby reducing color saturation and reproduction. Furthermore, when the addenda are incorporated directly in melts with the light sensitive halide emulsion, large speed losses instead of speed gains are seen. These are the specific problems to solve. What is needed is a photographic element that will deliver a higher speed with a given emulsion, without concomitant loss of interimage, or without the need to incorporate addenda by placing them in coating melts that are separate from the light sensitive silver halide emulsion.

U.S. Pat. No. 6,319,660 describes speed-improving compounds with at least three heteroatoms in a layer that contains a light-sensitive silver halide emulsion, or in a nonsilver-containing light insensitive layer. Among the speed improving compounds described are diazoles, and the most preferred diazoles include the 1-thia-3,4-diazoles where the C-5 substituent is a mercapto (—SH) group and the C-2 substituent is an alkyl, aryl, alkylthio, arylthio, or amino group. Compound BJ in U.S. Pat. No. 6,319,660 is such an exemplified mercaptothiadiazole that in Example 3 showed increased photographic sensitivity. However, these types of speed improving compounds suffer from two deficiencies.

The first problem is that the compounds of U.S. Pat. No. 6,319,660 give speed enhancements only when they are not mixed directly with the light sensitive silver halide emulsion prior to coating. When the compounds are mixed with the silver halide emulsion and the combination is held for a significant period of time before coating (commonly referred to as a single melt coating), the compounds in U.S. Pat. No. 6,319,660 give a speed loss, not a gain. For successful use, the compounds in U.S. Pat. No. 6,319,660 must be kept separate from the silver halide emulsion prior to coating and only mixed together immediately prior to the coating operation. This requires the preparation of two separate solutions that is undesirable. This undesirable coating procedure is called a dual-melt coating.

A second problem with the use of the compounds in U.S. Pat. No. 6,319,660 is that desirable interlayer interimage effects (IIEs) are diminished. For example, it is often desirable for color rendition that exposure to red or blue light will reduce green density being formed in green light sensitive sublayers. When the compounds in U.S. Pat. No. 6,319,660 are used in the green sublayers to increase the speed of those layers, the amount of green density suppression as a function of blue or red light exposure is less, and this is undesirable.

U.S. Pat. No. 5,187,054 describes ballasted heterocyclic compounds useful as antisludging agents. Typically, the compounds are azole derivatives that contain a ballast group to prevent diffusion of the compound. However, the compounds must be contained in a nonlight-sensitive layer, preferably the topmost nonlight-sensitive layer.

U.S. Pat. No. 6,190,848 describes art in which triazoles with Log Kow (see description of Log Kow below) from 4.75 to 9.0 are used in a light sensitive emulsion layer in combination with a second light sensitive layer that contains a compound that imagewise releases inhibitors with certain properties to improve interimage effects. However, the triazoles described within have insufficient Log Kow to cause speed increases and as noted (Column 7, lines 12–18), their laydown must be minimized in order to prevent excessive speed losses.

U.S. Pat. No. 6,140,029 describes a nonlight sensitive layer that contains elemental silver and a ring system that contains at least three nitrogen atoms, at least one N—H bond, and a Log Kow at least 4.5.

U.S. Pat. No. 6,228,572 describes a light sensitive layer that contains either a mercapto-oxadiazole, mercaptothiadiazole or mercaptoselenodiazole or their salts in combination with a second light sensitive layer that contains a compound that imagewise releases inhibitors with certain properties to improve interimage effects. It is a problem to be solved to provide a silver halide photographic element that contains an addenda that affords improved speed with little or no reduction in interimage effects and with improved melt-hold stability.

SUMMARY OF THE INVENTION

The invention provides a color photographic element comprising at least one light sensitive silver halide emulsion layer containing a compound that does not react with oxidized developer, has a Log Kow high enough to improve speed, compared to the same layer without the compound, and comprises (1) a thiadiazole, or (2) an oxadiazole, or (3) a 1,2,4 triazole bearing an amido substituent, and does not contain a hydroxyl or thiol group or their tautomeric equivalents on the azole ring.

Such an element affords improved speed with little or no reduction in interimage effects and with improved melt-hold stability.

DETAILED DESCRIPTION OF THE INVENTION

The invention is generally as described in the Summary of the Invention. The present invention relates to a light sensitive color photographic element with at least one red sensitive silver halide emulsion layer with at least one nondiffusing cyan coupler, at least one green sensitive silver halide emulsion layer with at least one nondiffusing magenta coupler and at least one blue sensitive silver halide emulsion layer with at least one nondiffusing yellow coupler, characterized in that at least one light sensitive silver halide emulsion layer comprises a thiadiazole, or an oxadiazole, or a 1,2,4-triazole bearing an amido substituent that does not react with oxidized developer, that has a Log Kow high enough to improve speed compared to the same layer without the compound, and that does not contain a hydroxy or thiol group or their tautomeric equivalents on the ring. It is desired that the compound useful in the invention should achieve an improvement in terms of photographic speed of at least 0.05, and desirably at least 0.10 and even 0.25 stops or more without causing a significant increase in granularity.

By one-stop increase in speed is meant that 50% of the standard amount of scene light gives the same photographic effect as a coating that does not have such a speed increase. The formula that relates stop to light exposure is $$\log(E/E_s)=(\text{stop})\log(0.50),$$

where stop is the measure of speed increase, $E_s$, is the standard exposure, and $E/E_s$ is the fractional exposure required as a result of the increase in speed. For example, a zero-stop increase means $E/E_s$ is unity. A one-stop increase in speed means $E/E_s$ is 0.50. A 0.10-stop increase in speed corresponds to an $E/E_s$ equal to 0.93.

As used herein the term amido group means a group comprising a nitrogen attached to the ring and then to an acid group such as an acyl, sulfonyl, aminocarbonyl, or sulfinyl group.

The phrase that the compound useful in the invention "does not react with oxidized developer" is meant to be an in-film result following the development step(s) of the photographic process. This restriction is made to distinguish compounds useful in the invention from other photographic materials that are commonly known to react with oxidized developer, such as but not limited to, couplers, scavengers of oxidized developer, and electron transfer agents. A test is to use a standard analytical method to analyze a standard film before and after standard processing for the presence of the compound. Any loss of compound useful in the invention caused by the processing should be less than 10% conversion in the compound.

The phrase that the invention compound does not contain a hydroxy or thiol group "or their tautomeric equivalent on the ring" means that the compound cannot proton-tautomerise by 1,3 or 1,5 or 1,7 shifts to produce a monocycle with hydroxy or thio groups.

The substituents located directly on the heterocycles useful in the invention can be hydrogen or any group except a hydroxy or thiol group or their tautomeric equivalents on the ring, chosen such that together the entire compound meets the overall Log Kow requirement. These substituents may be alkyl, aryl, alkyloxy or aryloxy, alkylthio or arylthio, sulfinyl, sulfonyl, aminosulfonyl ($R_2NSO_2$—), halo such as fluoro, chloro, bromo or iodo, cyano, nitro, oxycarbonyl (ROC(=O)—), oxysulfonyl ($ROSO_2$—), a heterocyclic group such as furanyl or morpholino, a carbonyl group such as keto, carboxylic acid (—$CO_2H$), or carbamoyl ($R_2NC$(=O)—) or an amino group such as a primary, secondary or tertiary substituted nitrogen. A substituent may also connect two or more independent nitrogen heterocycle nuclei together so long as the entire molecule still meets the Log Kow limitations. In addition, the substituent may further contain a group that can be incorporated into a polymeric backbone so long as the monomeric species meets the Log Kow limitations. It should be noted wherever it is possible to write alternative tautomeric structures of the heterocyclic nucleus, these are considered to be chemically equivalent and are part of the invention.

The 1,2,4-triazole is represented by Formula I-a:

I-a

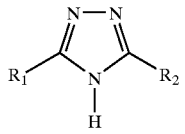

where $R_1$ is an alkylthio or alkyl group and $R_2$ is an amido substituent group being a substituent attached through an amine with an intermediate acid group such as a carbonyl, carbamoyl, oxycarbonyl, or sulfonyl group.

Also useful is a 1,2,4-triazole shown by Formula I-b:

I-b

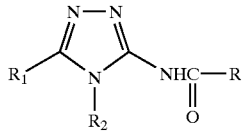

where $R_1$ is hydrogen or an alkyl or alkylthio group, $R_2$ is hydrogen or an alkyl group, and R is an alkyl or aryl group, and in which $R_1$ and $R_2$, or $R_2$ and R may optionally be connected to form a nonaromatic ring.

The oxadiazoles are 1-oxa-3,4-diazoles represented by Formula II.

II

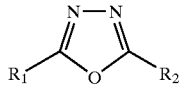

where $R_1$ and $R_2$ are independently chosen from the group consisting of hydrogen, and an alkyl, aryl, oxo, thio, amino, amido, sulfinyl, sulfonyl, cyano, acyloxy, fluoro, chloro, bromo, iodo, carbonyl, carbamoyl, oxycarbbnyl, or heteroaryl group. Especially preferred are 1-oxa-3,4-diazoles represented by Formula III:

III

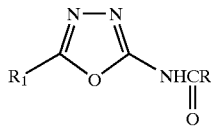

where $R_1$ is hydrogen or an alkyl or alkylthio group and R is an alkyl or aryl group.

The thiadiazoles are 1-thia-3,4-diazoles represented by Formula IV:

IV

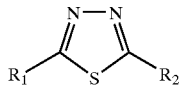

where $R_1$ and $R_2$ are independently chosen from the groups consisting of hydrogen and an alkyl, aryl, oxy, thio, amino, sulfinyl, sulfonyl, amido, cyano, fluoro, chloro, bromo, iodo, carbonyl, carbamoyl, acyloxy, oxycarbonyl, or hetero-aryl group. Especially preferred are 1-thia-3,4-diazoles represented by Formula V:

V

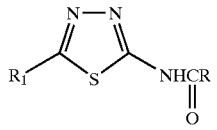

where $R_1$ is hydrogen or an alkyl or alkylthio group and R is an alkyl or aryl group. Most preferred are thiadiazoles represented by Formula VI:

VI

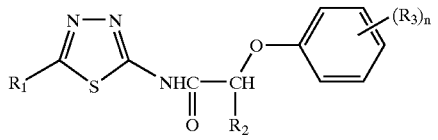

where $R_1$ is hydrogen or an alkyl thio group, $R_2$ is hydrogen or an alkyl group $R_3$ is an alkyl group branched at the point of attachment, and where n is one or two.

Also preferred are compounds represented by Formula V wherein $R_1$ or R are groups that contain a propyl group or the fragment

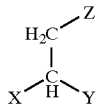

wherein X, Y, and Z are independently selected substituents. By propyl group we mean that $CH_3CH_2CH_2$— can be found as part of $R_1$ or R in Formula V. For example, a hexylthio group for $R_1$ comprises a propyl group. Similarly, we mean that the fragment shown above can be found as part of $R_1$ or R in Formula V.

The compounds useful in the invention are not couplers and do not react with oxidized developer (Dox) to generate dyes or any other product. It is desired that the compounds useful in the invention do not undergo any significant amounts (less than 5–10%) of chemical or redox reaction directly with oxidized color developer. They are colorless. They are stable to other components of the processing solutions and do not contain substituents that undergo substantial amounts of chemical reaction in any of the processing solutions. For example, the inventive materials do not contain hydrazino or hydroquinone groups that may cross-oxidize during silver development nor are they covalently linked to any other kind of photographic useful group (PUG). However, the inventive materials may contain, for example, ester substituents that are not substantially hydrolyzed (less than 5–10%) during the development process. The compounds useful in the invention are located in the film element as described and are not added to the processing solutions.

An important feature of the compounds useful in the invention is their lipophilicity, which is related to their octanol/water partition coefficient (logP). In order to maximize the photographic effect, the partitioning into water cannot be too high. Because it can be difficult to measure logP values above 3, a model can be used to compute an estimate of logP that defines the limits of the invention. The model used the software program by W. Meylan from Syracuse Research Corporation, 6225 Running Ridge Road, North Syracuse, N.Y., 13212. The compound whose logP is desired is entered into the program called KowWin, 32-bit Version 1.66 written in year 2000. The computed logP is called Log Kow. A literature article that describes the program is W. M. Meylan and P. H. Howard, Atom/fragment contribution method for estimating octanol-water partition coefficients, J. Pharm. Sci. 84: 83–92, 1995.

The compounds useful in the invention have a Log Kow high enough to improve speed compared to the coating without the compound. Preferably the Log Kow is 6.4 or greater. More preferably, the Log Kow is 8.5 or greater.

One reason for having the Log Kow or lipophilicity high enough is so that there will be a speed gain when the compound is present in the same melt as the emulsion prior to coating. Preferably, the lipophilicity is sufficiently high that there will be a speed increase even when the melt is held for at least one hour prior to coating.

Typically a speed increase is found when the compound is substituted with groups that together contain at least fourteen carbon atoms. Preferably the compound has an acylamino or ionizable NH group as a substituent with greater than fourteen carbon atoms.

Many examples of structures of this invention can be drawn in multiple tautomeric forms, for example, hydrogens on different ring atoms, enol or keto tautomeric forms, or thiol or thione forms for sulfur compounds. If Log Kow values can be calculated for more than one tautomeric form of a single compound and at least one of those values is within the specified range for that class, then the compound is within the scope of the invention.

For the purposes of this invention, the Log Kow refers to neutral molecules, even if they would be ionized or protonated (either fully or in part) at the processing pH or at the ambient pH of the photographic film. Thus, in practice, it is highly desirable that the substituents of the compound useful in the invention do not contain additional very low $pK_a(<7)$ groups such as sulfonic or carboxylic acids nor very basic groups (pKa of conjugate acid <10) such as a tertiary amino group (unless such an amino group is attached to a heterocyclic ring such that it is conjugated to a nitrogen atom, in which case its basicity is greatly reduced or is attached to an electronegative group such as carbonyl or sulfonyl) since they require an increase in the size and amount in the rest of the lipophilic substituents in order to meet the overall Log Kow requirements.

One of the most important and novel characteristics of the compounds of this invention is the finely tuned balance between their lipophilic and lipophobic nature. The lipophilic/lipophobic nature of a compound can be estimated by calculation of its partition coefficient between octanol and water (Log Kow) using the KowWin program, and this has been used herein to define the values of Log Kow for each class of compound within which they exhibit the desired effect. The terms 'ballast' or 'ballasted' as generally applied in the photographic art are often applied only loosely and without quantification to imply a restriction of movement. The activity of the inventive compounds is therefore best defined in terms of their calculated Log Kow values.

For each compound useful in the invention, as the laydown is increased a threshold level is reached following which the speed improvement gradually increases with laydown, after which the improvement then levels off at a compound specific maximum level. It will be appreciated that the amount is also a function of other variables such as the location and number of layers in which the compound is located, the solvent used, and film dimensions. Thus, it is desirable to have enough laydown of the compound in order to obtain the speed improvement Suitably, there is present sufficient laydown to achieve an improvement of at least 0.05, and desirably at least 0.10 and even 0.25 stops or more. Where the compound is present in a sensitized layer, the ratio of compound to silver is suitably at least 0.1 mmol of compound per mol of silver halide and, more preferably, at least 1.0 mmol of compound per mol of silver halide and, most preferably, at least 2.0 mmol per mol of silver halide.

The following are examples of compounds, along with the corresponding Log Kow values, that are useful in this invention:

A (11.8)

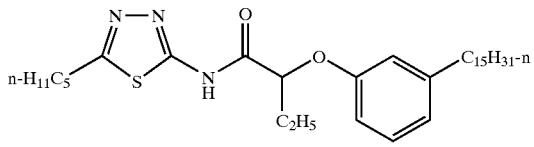

B (9.6)

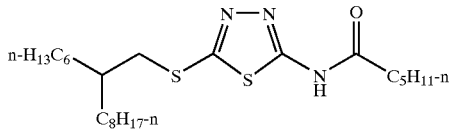

C (10.2)

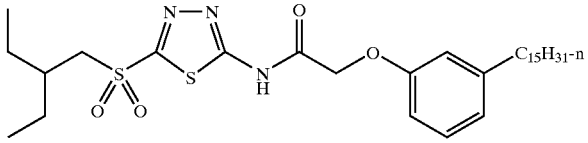

D (6.9)

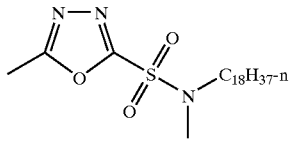

E (13.3)

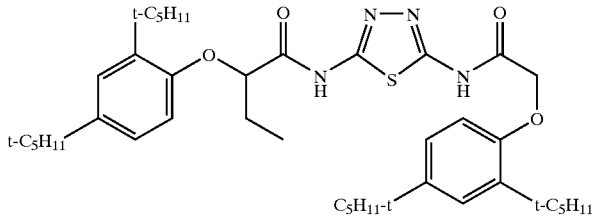

F (14.2)

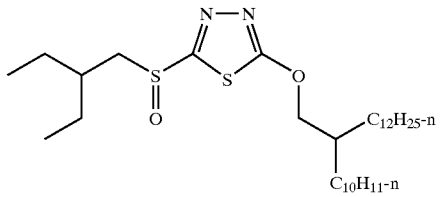

G (9.3)

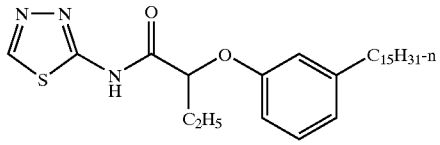

H (10.1)

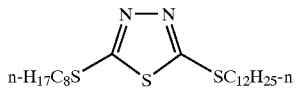

-continued
I (11.8)
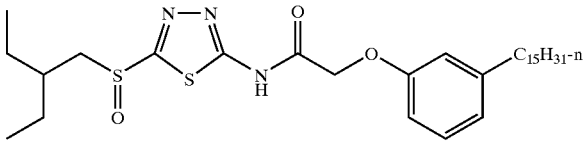
J (10.1)
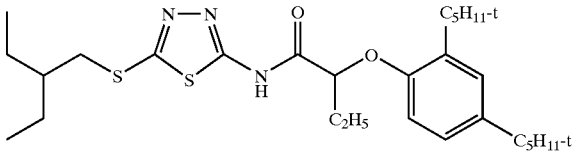
K (6.8)
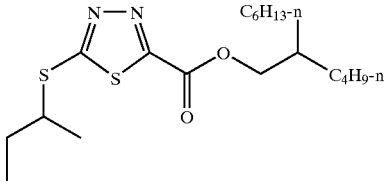
L (10.2)
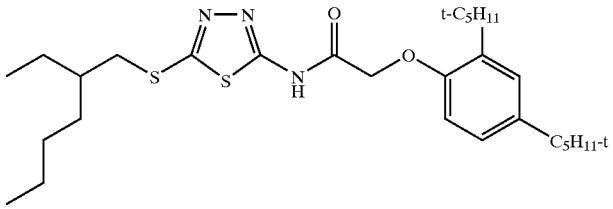
M (9.4)
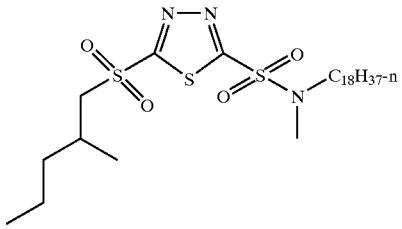
N (15.6)
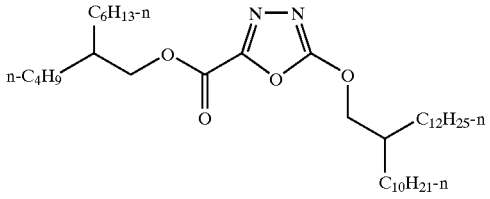
O (11.7)
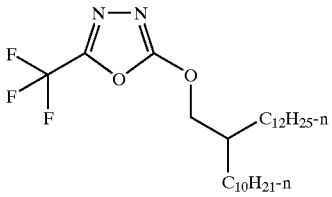
P (9.2)
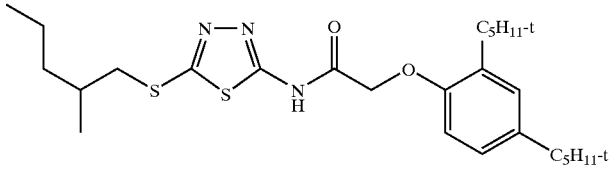

-continued
Q (16.7)
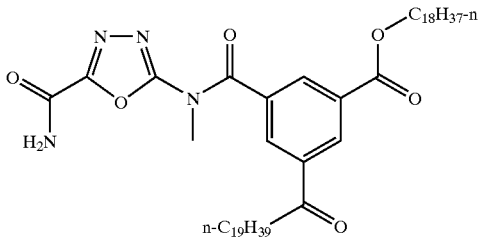
R (10.8)
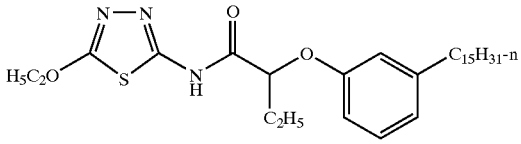
S (14.1)
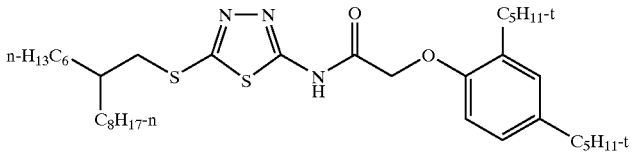
T (11.2)
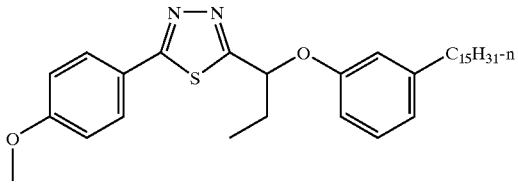
U (11.2)
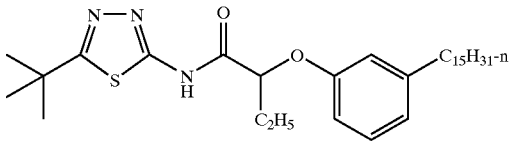
V (15.3)
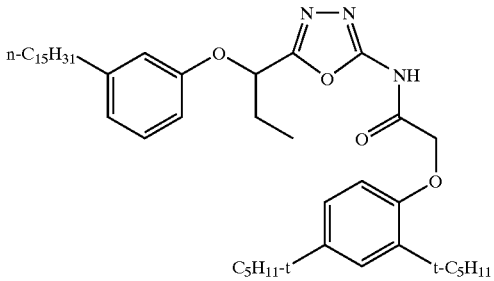
W (10.9)
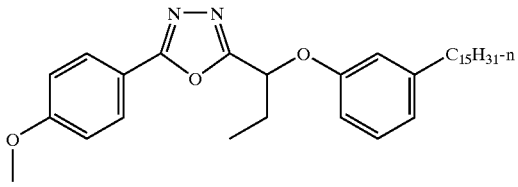
X (11.8)
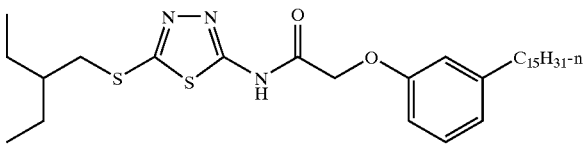

-continued
Y (12.2)
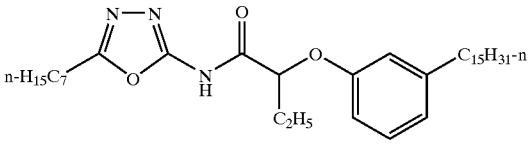
Z (7.4)
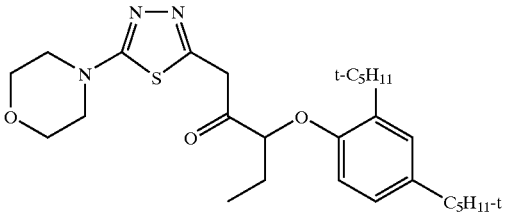
AA (11.3)
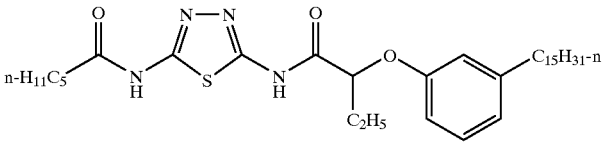
AB (10.2)
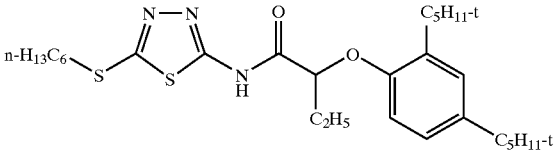
AC (9.3)
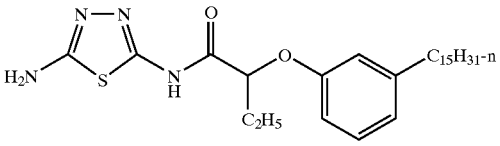
AD (8.5)
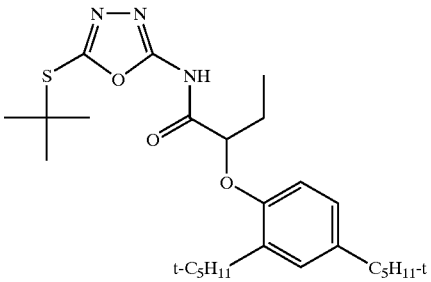
AE (6.9)
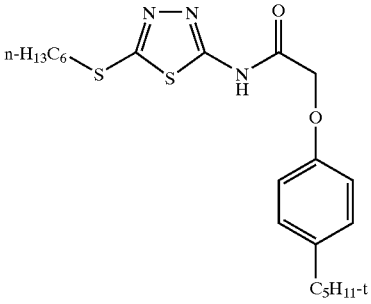

-continued
AF (7)
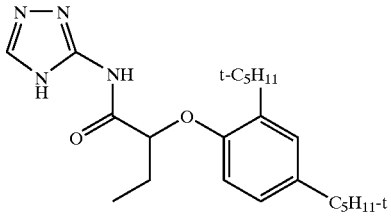
AG (13.3)
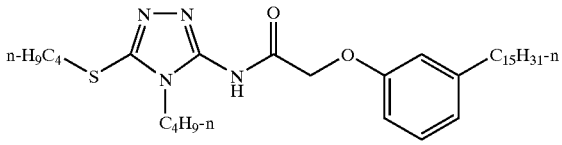
AH (9.1)
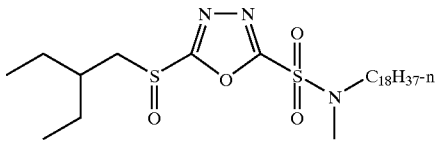
AI (11.8)
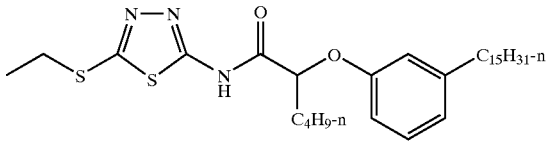
AJ (7.9)
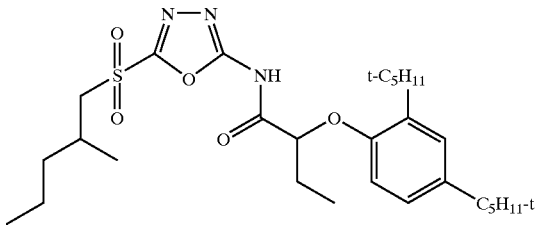
AK (11.2)
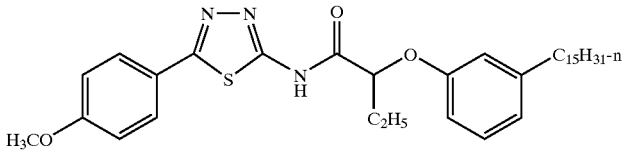
AL (9.9)
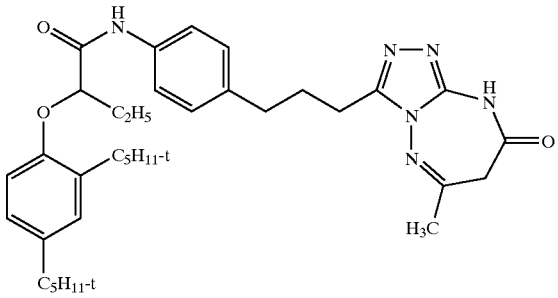
AM (10.2)
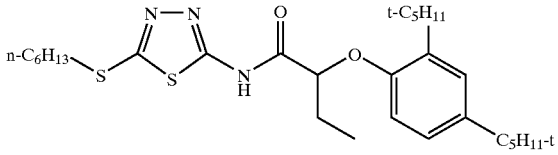

-continued
AN (11.4)
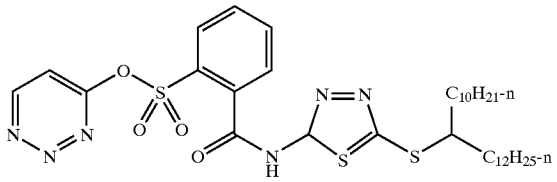
AO (12.4)
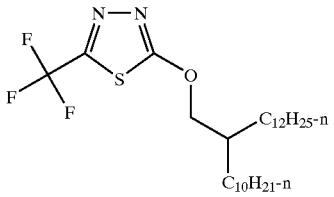
AP (7.3)
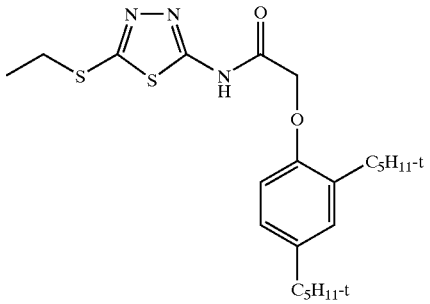
AQ (16.8)
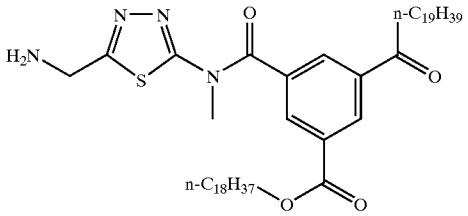
AR (11.1)
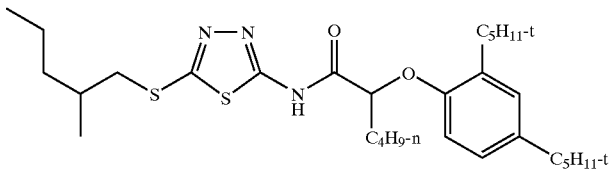
AS (10.3)
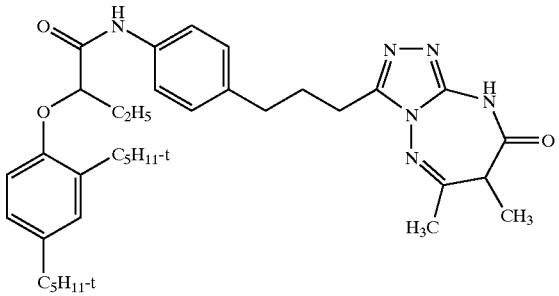

-continued

AT (7.1)

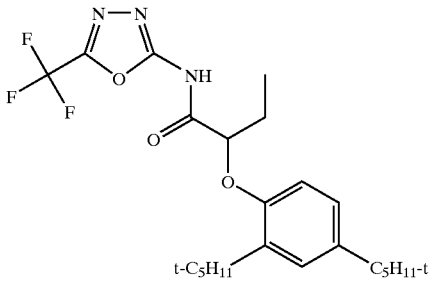

AU (12.8)

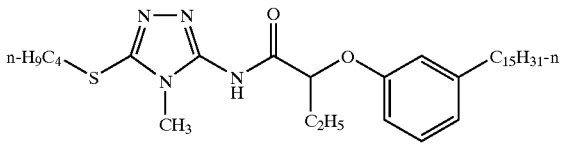

AV (6.8)

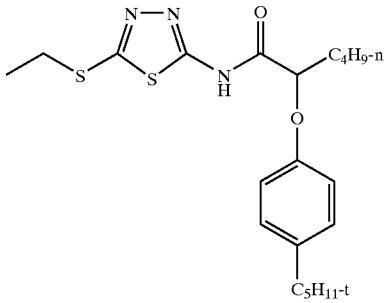

AW (6.7)

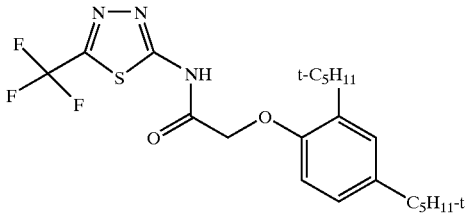

AX (6.9)

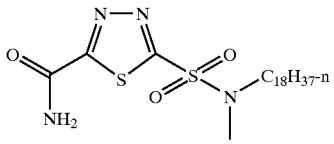

The materials useful in the invention can be added to a mixture containing silver halide before coating or be mixed with the silver halide just prior to or during coating. In either case, additional components like couplers, doctors, surfactants, hardeners and other materials that are typically present in such solutions may also be present at the same time. The materials useful in the invention are not water-soluble and cannot be added directly to the solution. They may be added directly if dissolved in an organic water miscible solvent such as methanol, acetone or the like or more preferably as a dispersion. A dispersion incorporates the material in a stable, finely divided state in a lipophilic organic solvent (often referred to as a permanent solvent) that is stabilized by suitable surfactants and surface active agents usually in combination with a binder or matrix such as gelatin. The dispersion may contain one or more permanent solvents that dissolve the material and maintain it in a liquid state. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Permanent solvents can also be described in terms of physical constants such as alpha, beta and pi* as defined by M. J. Kamlet, J-L. M. Abboud, M. H. Abraham and R. W. Taft, J. Org Chem, 48, 2877(1983). The preferred permanent solvents used with the materials useful in the invention are those with Log Kow of 5.0 or greater and beta values of 0.4 or greater or more preferably, beta values of 0.5 or greater. Preferred classes of solvents are carbonamides, phosphates, alcohols and esters. When a solvent is present, it is preferred that the weight proportion of compound to solvent be 1 to at least 0.5, or most preferably, 1 to at least 1. The dispersion may require an auxiliary coupler solvent initially to dissolve the component but this is removed afterwards, usually either by evaporation or by washing with additional water. Some examples of suitable auxiliary coupler solvents are ethyl acetate, cyclohexanone and 2-(2-butoxyethoxy)ethyl acetate. The dispersion may also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC or saponin. The materials useful in the invention may also be dispersed as an admixture with another component of the system such as a coupler or an oxidized developer scavenger so that both are present in the same oil droplet. It is also possible to incorporate the materials useful in the invention as a solid particle dispersion; that is, a slurry or suspension of finely ground (through mechanical means) compound. These solid particle dispersions may be additionally stabilized with surfactants and/or polymeric materials as known in the art. Also, additional permanent solvent may be added to the solid particle dispersion to help increase activity.

The sensitivity of the human eye is greatest to green light and so, the compounds useful in the invention are most useful when located in the green record (the layer whose maximum spectral sensitivity to light falls between 500 and 600 nm). The following magenta couplers are particularly beneficial when used in conjunction with the nitrogen heterocycles useful in the invention:

M-1:

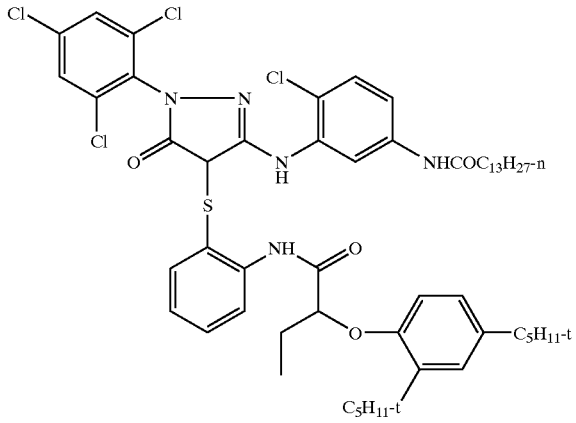

M-2:

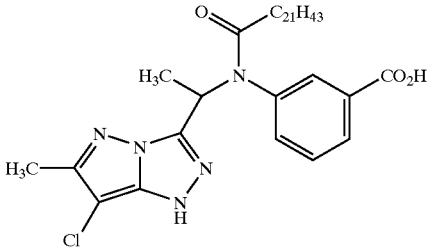

M-3:

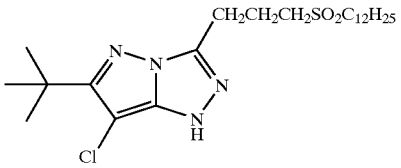

-continued

M-4:

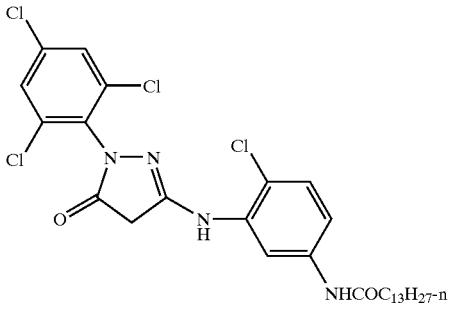

M-5:

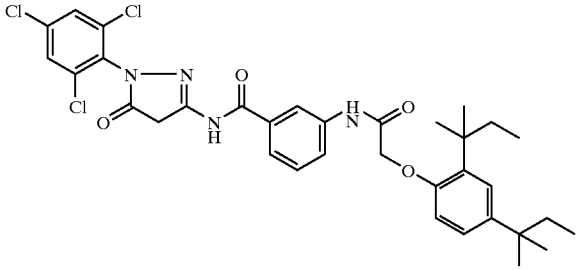

M-6:

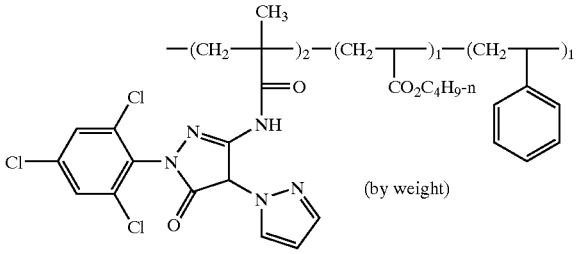

(by weight)

M-7:

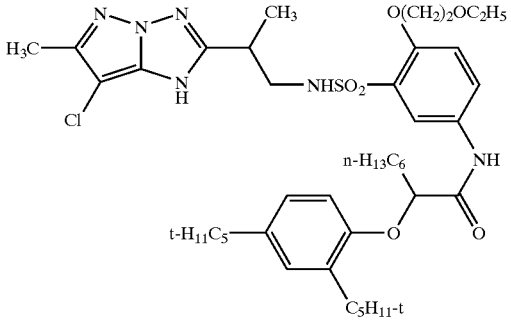

-continued
M-8:
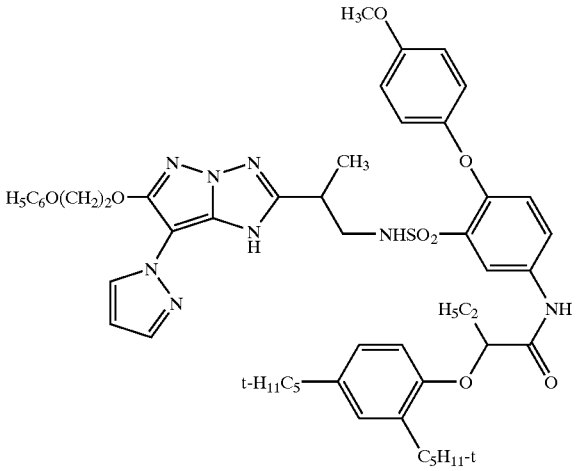
M-9:
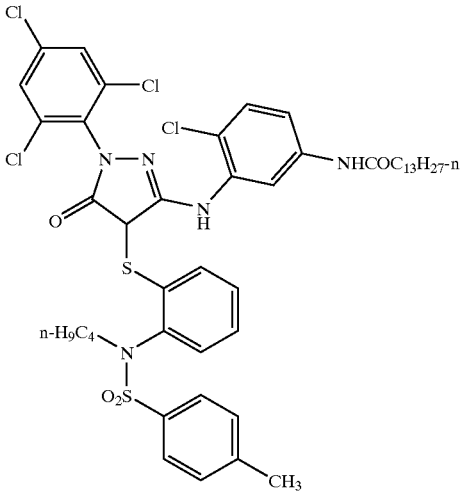
M-10:
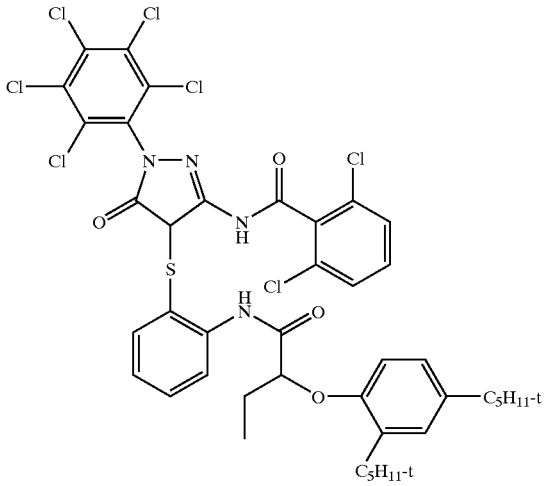
-continued
M-11:
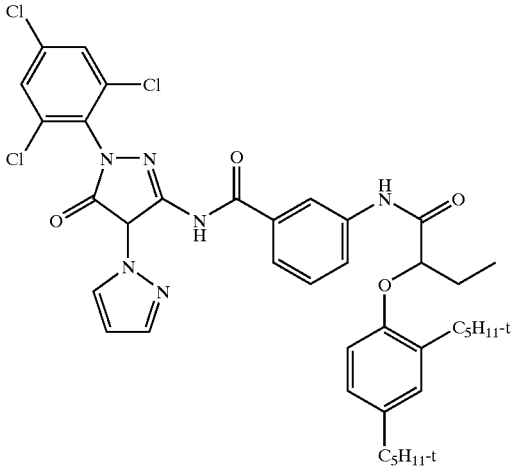
M-12:
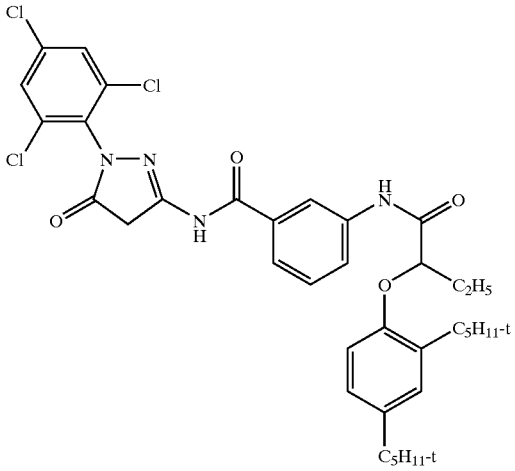
The following green sensitizing dyes are also particularly beneficial when used in combination with the nitrogen heterocycles useful in the invention:
GSD-1:
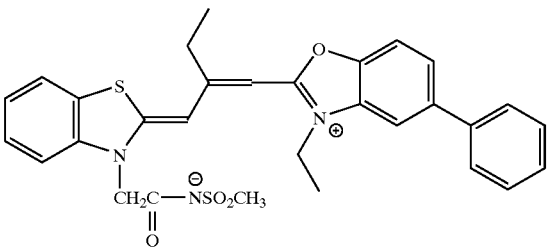

-continued
GSD-2:
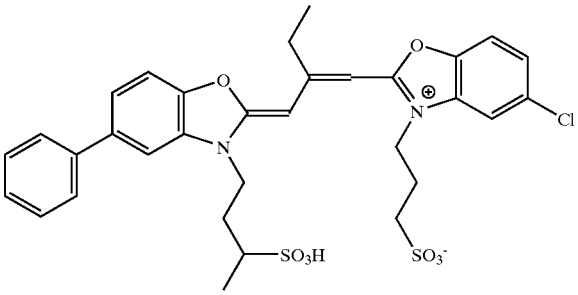
GSD-3:
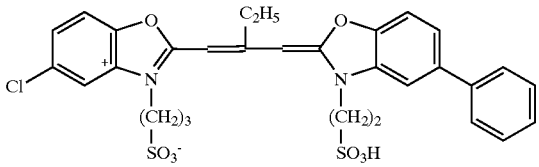
GSD-4:
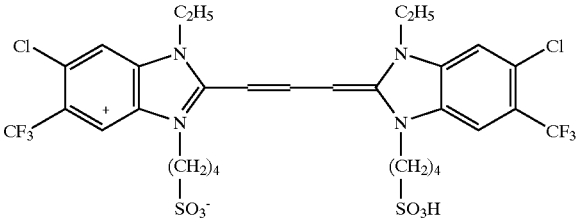
GSD-5:
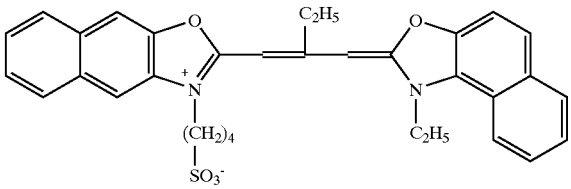
GSD-6:
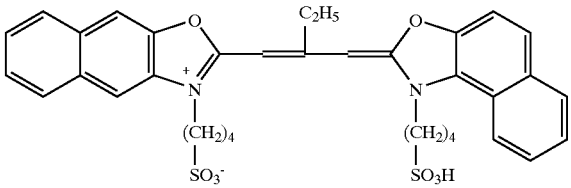
GSD-7:
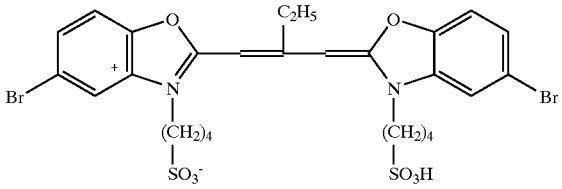
GSD-8:
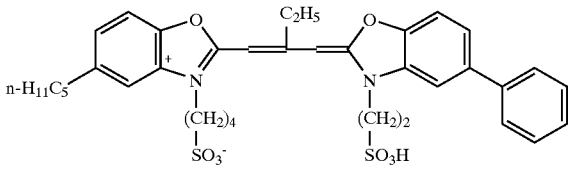
-continued
GSD-9:
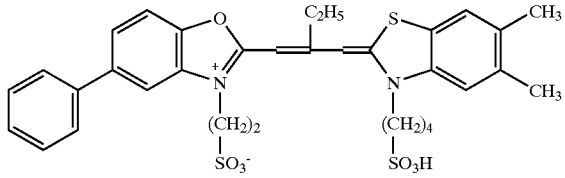
GSD-10:
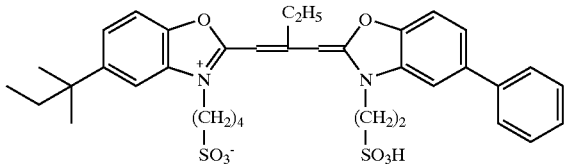
GSD-11:
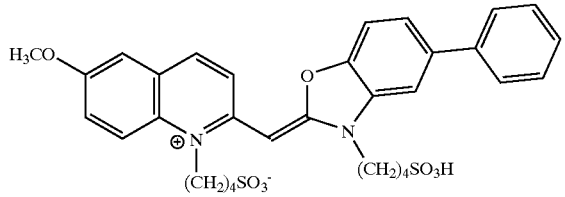
The compounds useful in the invention are also useful when located in the red record (the layer whose maximum spectral sensitivity to light falls between 600 and 700 nm). The following cyan couplers are particularly beneficial when used in conjunction with the heterocycles useful in the invention:
C-3
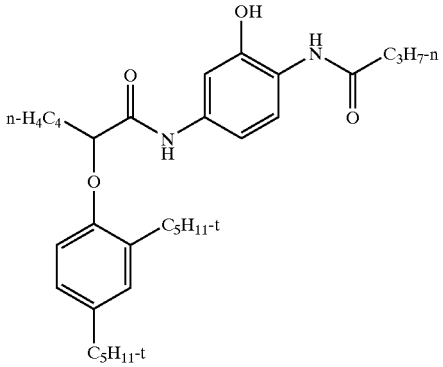
C-4
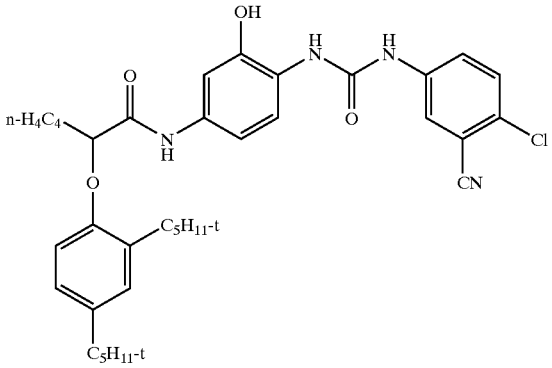

-continued
C-5
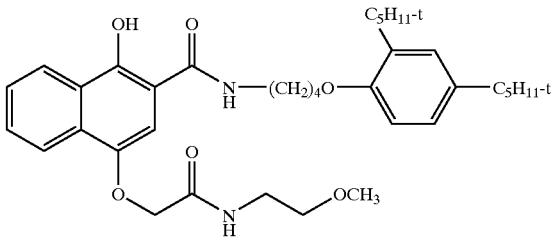
C-6
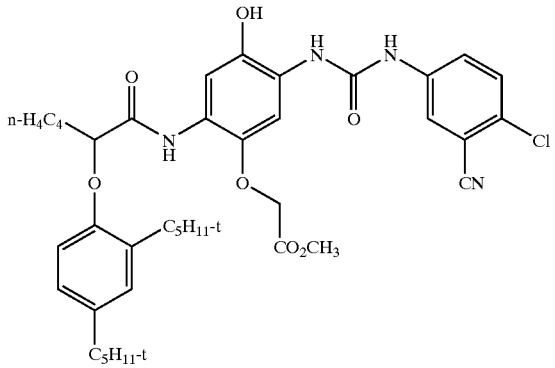
C-7
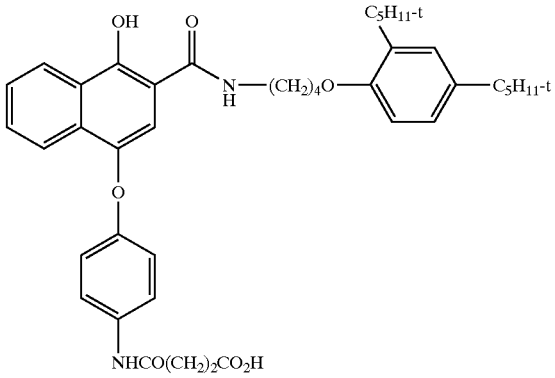
C-8
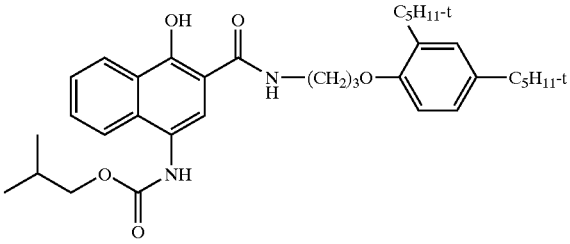
C-9
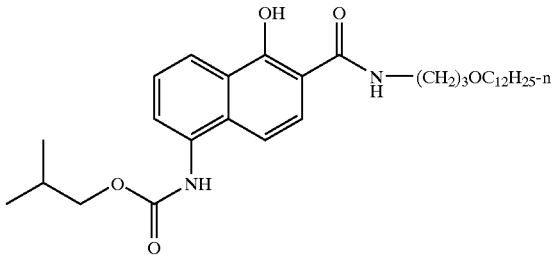
-continued
C-10
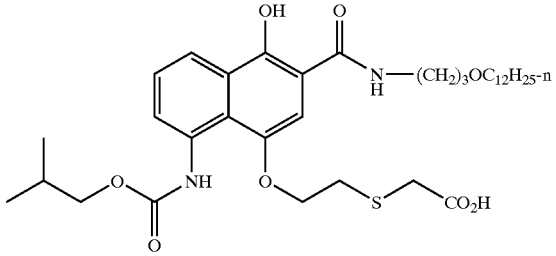
The following red sensitizing dyes are also particularly beneficial when used in combination with the heterocycles useful in the invention:
RSD-4:
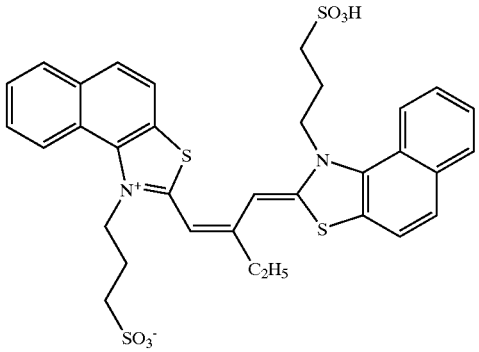
RSD-5:
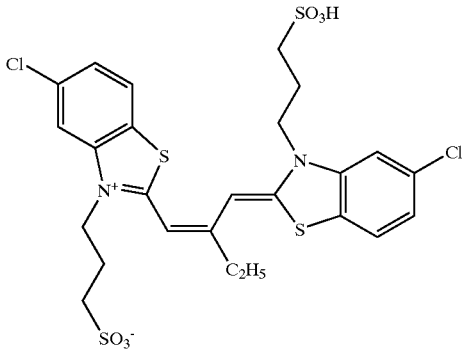
RSD-6:
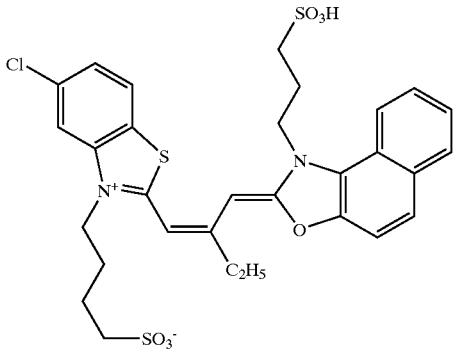

-continued

RSD-7:

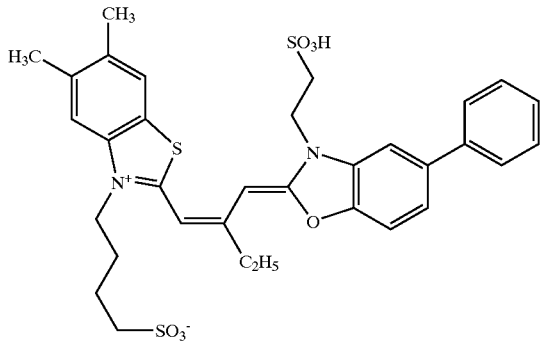

The type of light sensitive silver halide emulsion used in the layer that contains the compound useful in the invention may be important to obtain the desired increase in light sensitivity. The silver halide emulsion is suitably a silver iodobromide emulsion, meaning an emulsion that is low in chloride. By low in chloride, it is meant that there should be no more than 20 mol % chloride. The silver halide grains are comprised of at least 50 (preferably 70 and optimally 90) mol % bromide, based on silver, and at least 0.25 (preferably 0.5 and optimally 1.0) mol % iodide, based on silver, with any remaining halide being chloride. Although iodide can be incorporated up to its saturation level, typically about 40 mol % based on silver, it is preferred to limit iodide to less than 20 (preferably less than 10) mol % based on silver. Only about 5 mol % iodide is typically required to realize maximum photographic speeds. Additional iodide may be incorporated to serve other functions, such as increased native blue absorption or interimage effects. More suitably, there is present in the layer no more than 10-mol % chloride, and typically no more than 1 mol % chloride. The emulsion suitably contains at least 0.01-mol % iodide, or more preferably, at least 0.5 mol-% iodide or most preferably, at least 1-mol % iodide. The benefit of the increase in light sensitivity is most apparent in combination with larger sized emulsions that are associated with increased granularity. Thus, it is preferred that the compounds useful in the invention are used with emulsions that have an equivalent circular diameter of at least 0.6 $\mu$m, or more preferably, at least 0.8 $\mu$m, or most preferably, at least 1.0 $\mu$m. In addition, the benefit of the invention is greatest in origination materials such as color negative or color reversal materials since they require higher sensitivity to light (because of the variable lighting conditions in natural scenes) and low granularity (due to high magnification) relative to color print materials for which exposure conditions are carefully controlled and which are viewed directly under low magnification conditions.

The compounds useful in the invention are also particularly useful when used in film elements that contain low overall silver levels. Thus, films containing 9 g/m$^2$ of total silver or less, or more preferably 5.4 g/m$^2$ or less or even 4.3 g/m$^2$ or less benefit from the use of the compounds useful in the invention.

In order to control and maintain granularity over a wide exposure range, it is a common practice to divide an individual color record into separate layers, each containing silver halide emulsions of different degree of sensitivity to the same color of light. While the compound useful in the invention is most useful in the most light sensitive layer, it can be used in more than one record that is sensitive to the same color of light. For example, in a color record that is split into three layers of different relative sensitivity; fast (F), mid (M) or slow (S), the compound can be used in each layer only or in any combination; i.e. F+M, F+M+S, F+S, etc. It is not necessary that these layers be adjacent; that is, they may have interlayers or even imaging layers that are sensitive to other colors located between them. In addition, although the most light sensitive layer is typically located in the film structure closest to the exposure source and farthest from the support, the compounds useful in the invention allow for alternative locations of the layers; for example, a more light sensitive layer containing the compound useful in the invention may be located below (farther from the exposing source) than a less sensitive layer.

The preferred layer in which the compounds useful in the invention are used is the light sensitive layer that is the mostlight sensitive of two or more light sensitive layers of the same color. Especially preferred is where the most light sensitive layer uses a silver iodobromide emulsion and the compound useful in the invention has a Log Kow of 8.5 or greater. Most preferred is where the compound useful in the invention is selected from the following:

BV

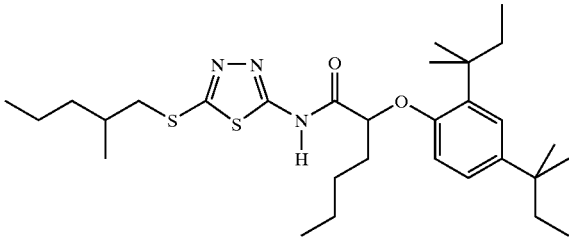

D

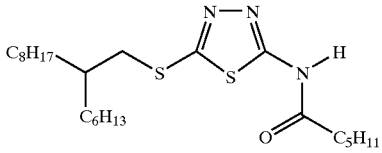

V

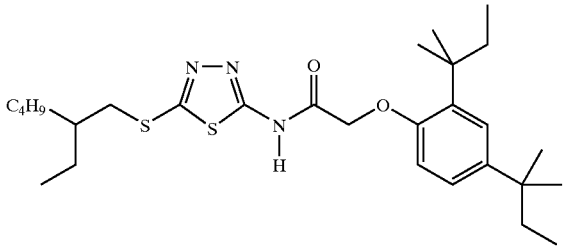

AQ

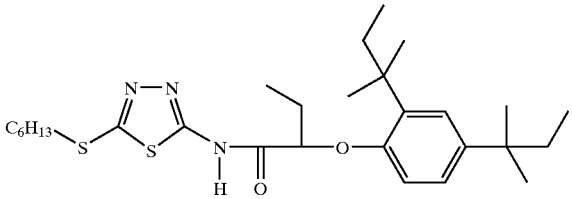

The phrase "in which the light sensitive layer is the most light sensitive of two or more light sensitive layers of the same color" means the following: a single color record such as the green record, can be composed of sublayers that are each sensitive to absorbing the same colored light from the scene. These sublayers are typically of different photographic speeds to provide greater latitude of the film to large ranges of scene exposure. When two or more such sublayers exist, the most light sensitive layer is the sublayer that responds to the lowest levels of scene exposure, unlike the other sublayers that require greater scene exposures.

It is also possible to use the compounds useful in the invention in more than one color record at a time. Moreover, when a number of layers of the same spectral sensitivity but of differing degrees of sensitivity to light are used, it is known that overall granularity can be minimized by using a smaller molar amount of dye-forming coupler than silver in the layers of higher sensitivity. Thus, it is preferred that the layers containing the compound useful in the invention additionally contain less than a stoichiometric amount of total dye forming coupler(s) relative to the amount of silver contained in the same layer. A suitable molar ratio of dye-forming coupler(s) to silver in the layer containing the compound useful in the invention would be less than 0.5. Most preferred would be a ratio of 0.2 or even 0.1 or less.

It is known that film elements can contain silver halide emulsions in one layer that have maximum sensitivities that are separated or shifted from emulsions in other layers that are sensitive to the same color of light (for example, a layer containing an emulsion with maximum sensitivity at ~530 nm whereas another layer contains a different green light sensitive emulsion which is most sensitive at ~550 nm) are useful for increasing the amount of interimage and improving color reproduction. The layer containing the emulsions with shifted sensitivities may not contain any image couplers at all, but rather only inhibitor releasing couplers (DIRs or DIARs (Development Inhibitor Anchimeric Releasing couplers)) or colored masking couplers. The compounds useful in the invention are particularly useful in this type of application since they allow for the improved color reproduction while maintaining or increasing speed of the element.

The compounds useful in the invention do not tend to increase the Dmin of the emulsion layer in which they are coated. Nevertheless, it is advantageous to use the compounds useful in the invention in combination with any of the antifoggants or scavengers known in the art to be useful in controlling Dmin or fog. Specific examples of scavengers for oxidized developers would be 2,5-di-t-octylhydroquinone, 2-(3,5-bis-(2-hexyl-dodecylamido) benzarnido)-1,4-hydroquinone, 2,4-(4-dodecyloxybenzenesulfonamido)phenol, 2,5-dihydroxy-4-(1-methylheptadecyl)benzenesulfonic acid or 2,5-di-s-dodecylhydroquinone. Specific examples of useful antifoggants are compounds AF-1 to AF-8 whose structures are shown below as well as 4-hydroxy-6-methyl-1,3,3a,7-tetraazaindene:

AF-1:

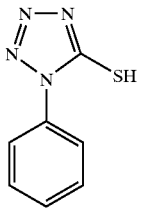

-continued

AF-2:

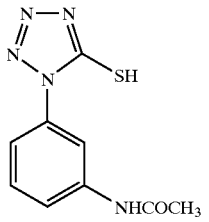

AF-3:

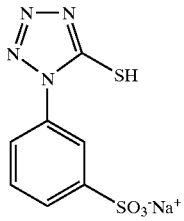

AF-4:

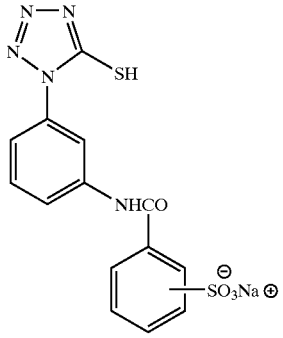

AF-5:

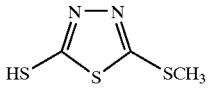

AF-6:

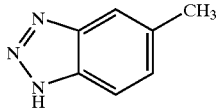

AF-7:

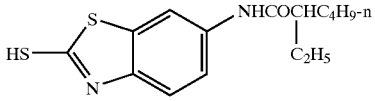

AF-8:

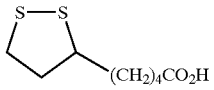

If the compounds useful in the invention have a suitable N—H group, the hydrogen may be optionally replaced with a group that is removed in a non-imagewise fashion during the development step to regenerate the original N—H group. In this case, it is the Log Kow of the unblocked compound that is important and should be calculated with the hydrogen present and without the blocking group. Any of the temporary blocking groups known in the art to decompose in the developer in a nonimagewise manner can be used for this purpose. Particularly useful are those blocking groups that rely on some specific component of the developer solution to cause decomposition and regeneration of the original substituent. One example of this kind of blocking group that relies on the hydroxylamine present in the developer is described in U.S. Pat. No. 5,019,492.

Unless otherwise specifically stated or when the term "group" is used, it is intended throughout this specification, when a substituent group contains a substitutable hydrogen, it is intended to encompass not only the substituent's unsubstituted form, but also its form further substituted with any group or groups as herein mentioned, so long as the group does not destroy properties necessary for photographic utility. Suitably, a substituent group may be bonded to the remainder of the molecule by an atom of carbon, silicon, oxygen, nitrogen, phosphorous, or sulfur. The substituent may be, for example halo such as chloro, bromo, iodo or fluoro; nitro; hydroxy, cyano; carboxyl; or groups which may be further substituted, such as alkyl, including straight or branched chain or cyclic alkyl, such as methyl, trifluoromethyl, ethyl, t-butyl, 3-(2,4-di-t-pentylphenoxy) propyl, and tetradecyl; alkenyl, such as vinyl, 2-butenyl; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy, aryl such as phenyl, 4-t-butylphenyl, 2,4,6trimethylphenyl, naphthyl; aryloxy, such as phenoxy, 2-methylphenoxy, alpha- or beta-naphthyloxy, and p-tolyloxy; carboxamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)hexanamido, alpha-(4-hydroxy-3-t-butylphenoxy)tetradecanamido, 2-oxo-1-pyrrolidinyl, 2-oxo-5-tetradecyl-1-pyrrolinyl, N-methyltetradecanamido, succinimido, phthalimido, 2,5-dioxo-1-oxazohdinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonyl amino, p-tolylcarbonylamino, N'-methylureido, N',N'-dimethylureido, N'-methyl-N'-dodecylureido, N'-hexadecylureido, N',N'-dioctadecylureido, N',N'-dioctyl-N-ethylureido, N'-phenylureido, N',N'-diphenylureido, N'-phenyl-N'-p-tolylureido, N'-(m-hexadecylphenyl)ureido, N',N'-(2,5-di-t-pentylphenyl)-N-ethylureido, and t-butylcarboxamido ; sulfonamido, such as methanesulfonamido, benzenesulfonamido, p-toluenesulfonamido, p-dodecylbenzenesulfonamido, N-methyltetradecanesulfonarnido, N',N'-dipropylsulfamoylamino, and hexadecanesulfonamido ; sulfamoyl, such as N-methylsulfamoyl, N-ethylsulfamoyl, N,N-dipropylsulfamoyl, N-hexadecylsulfamoyl, N,N-dimethylsulfamoyl; N-[3(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, pdodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and ptolylsulfonyl; sulfonyloxy, such as dodecylsulfonyloxy, and hexadecylsulfonyloxy, sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy, amino, such as phenylamino, 2-chlorophenylamino, diethylamino, dodecylamino; imido, such as N-(propanoyl)benzamido, succinimido or 3-benzylhydantoinyl; phosphato, such as dimethylphosphato and ethylbutylphosphato; phosphono, such as diethyl and dihexylphosphono; a heterocyclic group, a heterocyclic oxy group or a heterocyclic thio group, each of which may be substituted and which contain a 3 to 7 membered heterocyclic ring composed of carbon atoms and at least one hetero atom selected from the group comprising oxygen, nitrogen and sulfur, such as 2-furyl, 2-thienyl, 2-benzimidazolyloxy or 2-benzothiazolyl; quaternary ammonio such as triethylammonio ; and silyloxy, such as trimethylsilyloxy.

If desired, the substituents may themselves be further substituted one or more times with the described substituent groups. The particular substituents used maybe selected by those skilled in the art to attain the desired photographic properties for a specific application and can include, for example, lipophilic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

To control the migration of various components, it may be desirable to include a high molecular weight or polymeric backbone containing lipophilic or "ballast" group in molecules. Representative ballast groups include substituted or unsubstituted alkyl or aryl groups containing 8 to 48 carbon atoms. Representative substituents on such groups include alkyl, aryl, alkoxy, aryloxy, alkylthio, hydroxy, halo, alkoxycarbonyl, aryloxycarbonyl, carboxy, acyl, acyloxy, amino, anilino, carboxamido, carbamoyl, alkylsulfonyl, arylsulfonyl, sulfonamido, and sulfamoyl groups wherein the substituents typically contain 1 to 42 carbon atoms. Such substituents can also be further substituted.

As used herein, the term "color photographic element" means any element containing a light-sensitive silver halide emulsion layer containing an image dye-forming coupler. They can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer. A single color element may comprise a combination of couplers in one or more common layers which upon processing together form a monocolor, including black or gray, (so-called chromogenic black and white) dye image.

A typical color photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, or subbing layers.

If desired, the photographic element can be used in conjunction with an applied magnetic layer as described in Research Disclosure, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, Research Disclosure, June 1994, Item 36230, provides suitable embodiments.

In the following discussion of suitable materials for use in the emulsions and elements of this invention, reference will be made to *Research Disclosure*, September 1996, Item 38957, available as described above, which is referred to herein by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V of *Research Disclosure*, September 1996, Item 38957. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. The information contained in the September 1994 *Research Disclosure*, Item No. 36544 referenced above, is updated in the September 1996 *Research Disclosure*, Item No. 38957. Certain desirable photographic elements and processing steps, including those useful in conjunction with color reflective prints, are described in *Research Disclosure*, Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, or color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, heterocyclyl, benzotriazoyl, sulfonamido, tetrazoylthio, benzothiazolylthio, 2-carboxyethylthio, phosphonyloxy, arylthio, and aryldiazenyl. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in UK. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents that are described in such representative patents and publications as: "Farbkuppler-eine Literature Ubersicht," published in Agfa Mitteilungen, Band III, pp. 156–175 (1961) as well as in U.S. Pat. Nos. 2,367,531; 2,423,730; 2,474,293; 2,772,162; 2,895,826; 3,002,836; 3,034,892; 3,041,236; 4,333,999; 4,746,602; 4,753,871; 4,770,988; 4,775,616; 4,818,667; 4,818,672; 4,822,729; 4,839,267; 4,840,883; 4,849,328; 4,865,961; 4,873,183; 4,883,746; 4,900,656; 4,904,575; 4,916,051; 4,921,783; 4,923,791; 4,950,585; 4,971,898; 4,990,436; 4,996,139; 5,008,180; 5,015,565; 5,011,765; 5,011,766; 5,017,467; 5,045,442; 5,051,347; 5,061,613; 5,071,737; 5,075,207; 5,091,297; 5,094,938; 5,104,783; 5,178,993; 5,813,729; 5,187,057; 5,192,651; 5,200,305; 5,202,224; 5,206,130; 5,208,141; 5,210,011; 5,215,871; 5,223,386; 5,227,287; 5,256,526; 5,258,270; 5,272,051; 5,306,610; 5,326,682; 5,366,856; 5,378,596; 5,380,638; 5,382,502; 5,384,236; 5,397,691; 5,415,990; 5,434,034; 5,441,863; EPO 0 246 616; EPO 0 250 201; EPO 0 271 323; EPO 0 295 632; EPO 0 307 927; EPO 0 333 185; EPO 0 378 898; EPO 0 389 817; EPO 0 487 111; EPO 0 488 248; EPO 0 539 034; EPO 0 545 300; EPO 0 556 700; EPO 0 556 777; EPO 0 556 858; EPO 0 569 979; EPO 0 608 133; EPO 0 636 936; EPO 0 651286; EPO 0 690 344; German OLS 4,026,903; German OLS 3,624,777 and German OLS 3,823,049. Typically such couplers are phenols, naphthols, or pyrazoloazoles.

Couplers that form magenta dyes upon reaction with oxidized color developing agent are described in such representative patents and publications as: "Farbkuppler-eine Literature Ubersicht," published in Agfa Mitteilungen, Band III, pp. 126–156 (1961) as well as U.S. Pat. Nos. 2,311,082 and 2,369,489; 2,343,701; 2,600,788; 2,908,573; 3,062,653; 3,152,896; 3,519,429; 3,758,309; 3,935,015; 4,540,654; 4,745,052; 4,762,775; 4,791,052; 4,812,576; 4,835,094; 4,840,877; 4,845,022; 4,853,319; 4,868,099; 4,865,960; 4,871,652; 4,876,182; 4,892,805; 4,900,657; 4,910,124; 4,914,013; 4,921,968; 4,929,540; 4,933,465; 4,942,116; 4,942,117; 4,942,118; 4,959,480; 4,968,594; 4,988,614; 4,992,361; 5,002,864; 5,021,325; 5,066,575; 5,068,171; 5,071,739; 5,100,772; 5,110,942; 5,116,990; 5,118,812; 5,134,059; 5,155,016; 5,183,728; 5,234,805; 5,235,058; 5,250,400; 5,254,446; 5,262,292; 5,300,407; 5,302,496; 5,336,593; 5,350,667; 5,395,968; 5,354,826; 5,358,829; 5,368,998; 5,378,587; 5,409,808; 5,411,841; 5,418,123; 5,424,179; EPO 0 257 854; EPO 0 284 240; EPO 0 341 204; EPO 347,235; EPO 365,252; EPO 0 422 595; EPO 0 428 899; EPO 0 428 902; EPO 0 459 331; EPO 0 467 327; EPO 0 476 949; EPO 0 487 081; EPO 0 489 333; EPO 0 512 304; EPO 0 515 128; EPO 0 534 703; EPO 0 554 778; EPO 0 558 145; EPO 0 571 959; EPO 0 583 832; EPO 0 583 834; EPO 0 584 793; EPO 0 602 748; EPO 0 602 749; EPO 0 605 918; EPO 0 622 672; EPO 0 622 673; EPO 0 629 912; EPO 0 646

841, EPO 0 656 561; EPO 0 660 177; EPO 0 686 872; WO 90/10253; WO 92109010; WO 92/10788; WO 92/12464; WO 93/01523; WO 93/02392; WO 93/02393; WO 93/07534; UK Application 2,244,053; Japanese Application 03192-350; German OLS 3,624,103; German OLS 3,912, 265; and German OLS 40 08 067. Typically such couplers are pyrazolones, pyrazoloazoles, or pyrazolobenzimidazoles that form magenta dyes upon reaction with oxidized color developing agents.

Couplers that form yellow dyes upon reaction with oxidized color developing agent are described in such representative patents and publications as: "Farbkuppler-eine Literature Ubersicht," published in Agfa Mitteilungen; Band III; pp. 112–126 (1961); as well as U.S. Pat. Nos. 2,298,443; 2,407,210; 2,875,057; 3,048,194; 3,265,506; 3,447,928; 4,022,620; 4,443,536; 4,758,501; 4,791,050; 4,824,771; 4,824,773; 4,855,222; 4,978,605; 4,992,360; 4,994,361; 5,021,333; 5,053,325; 5,066,574; 5,066,576; 5,100,773; 5,118,599; 5,143,823; 5,187,055; 5,190,848; 5,213,958; 5,215,877; 5,215,878; 5,217,857; 5,219,716; 5,238,803; 5,283,166; 5,294,531; 5,306,609; 5,328,818; 5,336,591; 5,338,654; 5,358,835; 5,358,838; 5,360,713; 5,362,617; 5,382,506; 5,389,504; 5,399,474; 5,405,737; 5,411,848; 5,427,898; EPO 0 327 976; EPO 0 296 793; EPO 0 365 282; EPO 0 379 309; EPO 0 415 375; EPO 0 437 818; EPO 0 447 969; EPO 0 542 463; EPO 0 568 037; EPO 0 568 196; EPO 0 568 777; EPO 0 570 006; EPO 0 573 761; EPO 0 608 956; EPO 0 608 957; and EPO 0 628 865. Such couplers are typically open chain ketomethylene compounds.

Couplers that form colorless products upon reaction with oxidized color developing agent are described in such representative patents as: UK. 861,138; U.S. Pat. Nos. 3,632, 345; 3,928,041; 3,958,993 and 3,961,959. Typically such couplers are cyclic carbonyl-containing compounds that form colorless products on reaction with an oxidized color-developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color-developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151, 343, and 5,234,800.

It may be useful to use a combination of couplers any of which may contain known ballasts or coupling-off groups such as those described in U.S. Pat. No. 4,301,235; U.S. Pat. No. 4,853,319 and U.S. Pat. No. 4,351,897. The coupler may contain solubilizing groups such as described in U.S. Pat. No. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; UK. Patent 1,530,272; and Japanese Application 58-113935. The masking couplers maybe shifted or blocked, if desired.

The invention materials may be used in association with materials that release Photographically Useful Groups (PUGS) that accelerate or otherwise modify the processing steps e.g. of bleaching or fixing to improve the quality of the image. Bleach accelerator releasing couplers such as those described in EP 193,389; EP 301,477; U.S. Pat. No. 4,163, 669; U.S. Pat. No. 4,865,956; and U.S. Pat. No. 4,923,784, maybe useful. Also contemplated is use of the compositions in association with nucleating agents, development accelerators or their precursors (UK Patent 2,097,140; UK. Patent 2,131,188); electron transfer agents (U.S. Pat. No. 4,859, 578; U.S. Pat. No. 4,912,025); antifogging and anticolor-mixing agents such as derivatives of hydroquinones, aminophenols, amines, gallic acid; catechol; ascorbic acid; hydrazides; sulfonamidophenols; and noncolor-forming couplers.

The invention materials may also be used in combination with filter dye layers comprising yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. No. 4,420,556; and U.S. Pat. No. 4,543,323.) Also, the compositions may be blocked or coated in protected form as described, for example, in Japanese Application 61/258,249 or U.S. Pat. No. 5,019,492.

The invention materials may further be used in combination with image-modifying compounds that release PUGS such as "Developer Inhibitor-Releasing" compounds (DIRs). DIRs useful in conjunction with the compositions useful in the invention are known in the art and examples are described in U.S. Pat. Nos. 3,137,578; 3,148,022; 3,148, 062; 3,227,554; 3,384,657; 3,379,529; 3,615,506; 3,617, 291; 3,620,746; 3,701,783; 3,733,201; 4,049,455; 4,095, 984; 4,126,459; 4,149,886; 4,150,228; 4,211,562; 4,248, 962; 4,259,437; 4,362,878; 4,409,323; 4,477,563; 4,782, 012; 4,962,018; 4,500,634; 4,579,816; 4,607,004; 4,618, 571; 4,678,739; 4,746,600; 4,746,601; 4,791,049; 4,857, 447; 4,865,959; 4,880,342; 4,886,736; 4,937,179; 4,946, 767; 4,948,716; 4,952,485; 4,956,269; 4,959,299; 4,966, 835; 4,985,336 as well as in patent publications GB 1,560, 240; GB 2,007,662; GB 2,032,914; GB 2,099,167; DE 2,842,063, DE 2,937,127; DE 3,636,824; DE 3,644,416 as well as the following European Patent Publications: 272, 573; 335,319; 336,411; 346, 899; 362, 870; 365,252; 365, 346; 373,382; 376,212; 377,463; 378,236; 384,670; 396, 486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering*, Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) that also include a timing moiety or chemical switch that produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzbthiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

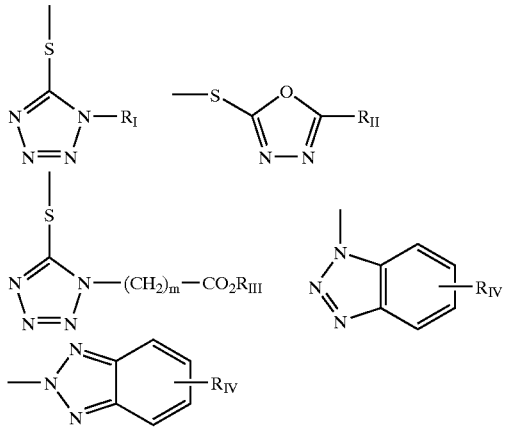

wherein $R_I$ is selected from the group comprising straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group comprising hydrogen, halogens and alkoxy, phenyl and carboxamido groups, —$COOR_V$ and —$NHCOOR_V$ wherein $R_V$ is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. No. 4,438,193; U.S. Pat. No. 4,618,571) and groups that combine the features described above. It is typical that the timing group is of one of the formulas:

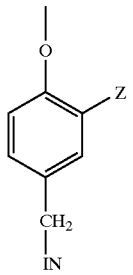

-continued

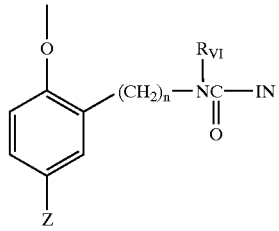

wherein IN is the inhibitor moiety, Z is selected from the group comprising nitro, cyano, alkylsulfonyl; sulfamoyl ($R2NSO_2$—); and sulfonamido ($RSO_2NR$—) groups; n is 0 or 1; and $R_{VI}$ is selected from the group comprising substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers that may be included in photographic light sensitive emulsion layer include, but are not limited to, the following:

D1

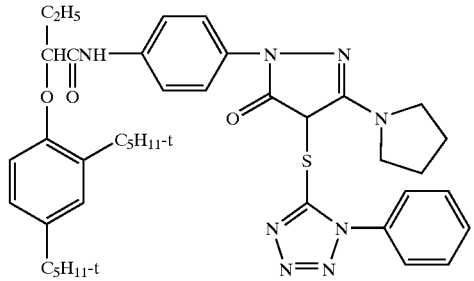

D2

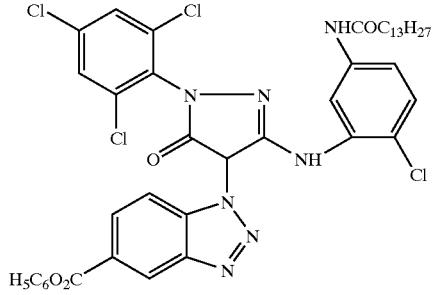

-continued
D3
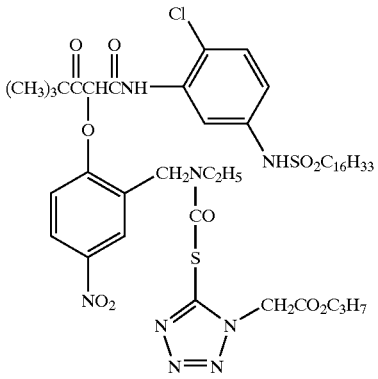
D4
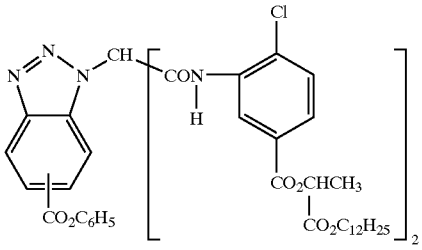
D5
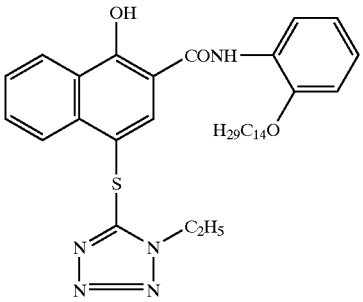
D6
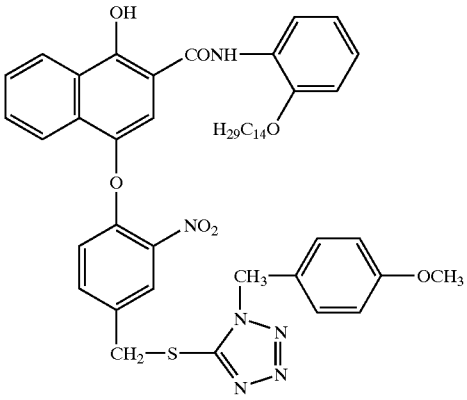
-continued
D7
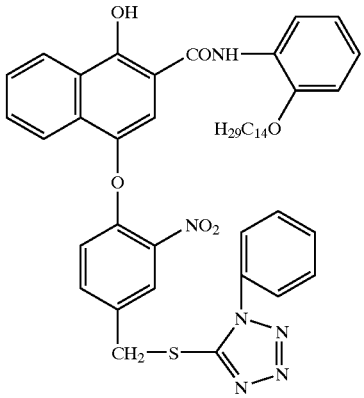
D8
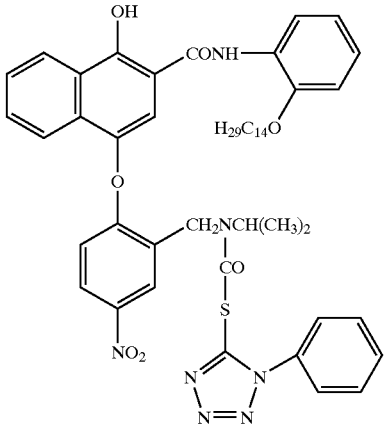
D9
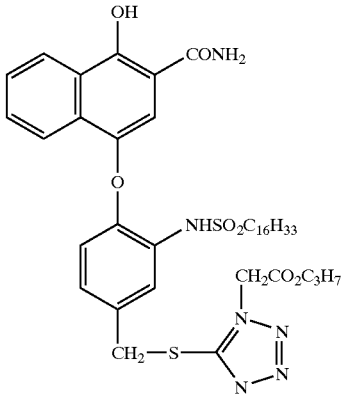

-continued

D10

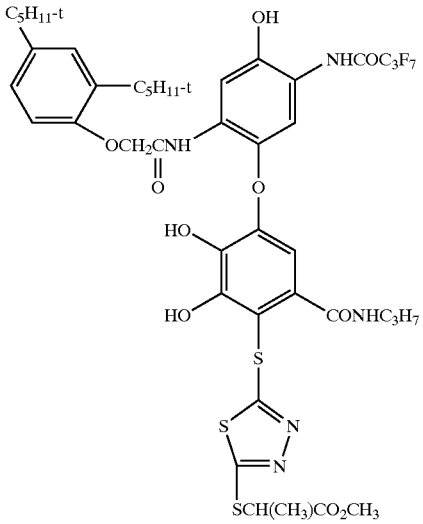

D11

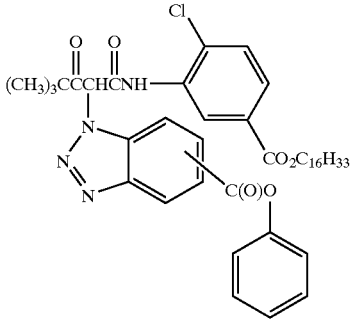

D12

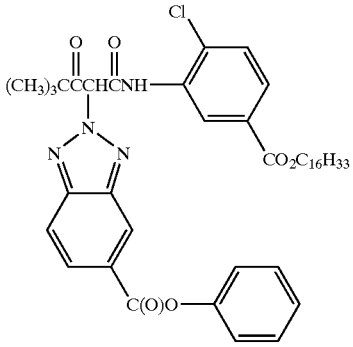

A light-sensitized silver halide emulsion layer is a sublayer of the photographic film that contains light-sensitized silver halide crystals incorporated as an emulsion in the sublayer, utilizing emulsifying agents such as, but not limited to, gelatin. Silver halide is light-sensitized by the use of sensitizing dyes that are adsorbed to the silver halide crystals and that capture scene light and initiate formation of the scene latent image silver.

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). The major faces of the tabular grains can lie in either {111} or {100} crystal planes. Specifically contemplated tabular grain emulsions are those in which greater than 50% of the total projected area of the emulsion grains are accounted for by tabular grains having a thickness of less than 0.3 μm (0.5 μm for blue sensitive emulsion) and an average tabularity (T) of greater than 25 (preferably greater than 100), where the term "tabularity" is employed in its art recognized usage as $$T=ECD/t^2$$

where ECD is the average equivalent circular diameter of the tabular grains in micrometers and t is the average thickness in micrometers of the tabular grains.

The average useful ECD of photographic emulsions can range up to about 10 μm, although in practice emulsion ECDs seldom exceed about 4 μm. Since both photographic speed and granularity increase with increasing ECDs, it is generally preferred to employ the smallest tabular grain ECDs compatible with achieving aim speed requirements.

Emulsion tabularity increases markedly with reductions in tabular grain thickness. It is generally preferred that aim tabular grain projected areas be satisfied by thin (t less than 0.2 μm) tabular grains. To achieve the lowest levels of granularity it is preferred that aim tabular grain projected areas be satisfied with ultrathin (t less than 0.07 μm) tabular grains. Tabular grain thicknesses typically range down to about 0.02 μm. However, still lower tabular grain thicknesses are contemplated. For example, Daubendiek et al. U.S. Pat. No. 4,672,027 reports a 3-mol % iodide tabular grain silver bromoiodide emulsion having a grain thickness of 0.017 μm. Ultrathin tabular grain high chloride emulsions are disclosed by Maskasky U.S. Pat. No. 5,217,858.

As noted above tabular grains of less than the specified thickness account for at least 50% of the total grain projected area of the emulsion. To maximize the advantages of high tabularity it is generally preferred that tabular grains satisfying the stated thickness criterion account for the highest conveniently attainable percentage of the total grain projected area of the emulsion. For example, in preferred emulsions, tabular grains satisfying the stated thickness criteria above account for at least 70% of the total grain projected area. In the highest performance tabular grain emulsions, tabular grains satisfying the thickness criteria above account for at least 90% of total grain projected area Suitable tabular grain emulsions can be selected from among a variety of conventional teachings, such as those of the following Research Disclosure, Item 22534, January 1983, published by Kenneth Mason Publications, Ltd., Emsworth, Hampshire P010 7DD, England; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069 and 5,061,616. Tabular grain emulsions comprising predominantly silver chloride are useful and are described, for example, in U.S. Pat. No. 5,310,635; 5,320,938; and 5,356,764.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. 4,656,122, Piggin et al U.S. Pat. Nos. 5,061,616 and 5,061,609, Tsaur et al U.S. Pat. Nos. 5,147,771, 5,147,772, 5,147,773, 5,171,659 and 5,252,453, Black et al 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniades et al U.S. Pat. No. 5,250,403, Olm et al U.S. Pat. No.

5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. 5,356,764, Chang et al U.S. Pat. Nos. 5,413,904 and 5,663,041, Oyamada U.S. Pat. 5,593,821, Yamashita et al U.S. Pat. Nos. 5,641,620 and 5,652,088, Saitou et al U.S. Pat. Nos. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color-developing agent to reduce developable silver halide and oxidize the color-developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromoiodide emulsions and may be processed, for example, in known color negative processes such as the Kodak C-41™ process as described in The British Journal of Photography Annual of 1988, pages 191–198. If a color negative film element is to be subsequently employed to generate a viewable projection print as for a motion picture, a process such as the Kodak ECN-2™ process described in the H-24 Manual available from Eastman Kodak Co. may be employed to provide the color negative image on a transparent support. Color negative development times are typically 3 min 15 s. The photographic element of the invention can be incorporated into exposure structures intended for repeated use or exposure structures intended for limited use, variously referred to by names such as "single use cameras", "lens with film", or "photosensitive material package units".

A reversal element is capable of forming a positive image without optical printing. To provide a positive (or reversal) image, the color development step is preceded by development with a nonchromogenic developing agent to develop exposed silver halide, but not form dye, and followed by uniformly fogging the element to render unexposed silver halide developable. Such reversal emulsions are typically sold with instructions to process using a color reversal process such as the Kodak E-6™ process. Alternatively, a direct positive emulsion can be employed to obtain a positive image.

The above emulsions are typically sold with instructions to process using the appropriate method such as the mentioned color negative (Kodak C-41) or reversal (Kodak E-6) process.

Preferred color developing agents are p-phenylenediamines such as: 4-amino-N,N-diethylaniline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methanesulfonamidoethyl)-N,N-diethylaniline hydrochloride, and 4-amino-N-ethyl-N-(2-methoxyethyl)-m-toluidine di-p-toluene sulfonic acid.

Of the above, developers based on 4-amino-3-methyl-N-cthyl-N-(2-hydroxyethyl)aniline and 4-amino-3-methyl-N-ethyl-N-(2-methanesulfonamidoethyl)aniline are especially preferred. Moreover, because the compounds useful in the invention give increased light sensitivity, they are especially useful in processes that have shortened development times. In particular, the film elements of the invention can be processed with development times of less than 3.25 min or even less than 3 min or in extreme cases, even less than 120 s.

Development is usually followed by the conventional steps of bleaching, fixing, or bleach-fixing, to remove silver or silver halide, washing, and drying, Synthesis of Compound AK

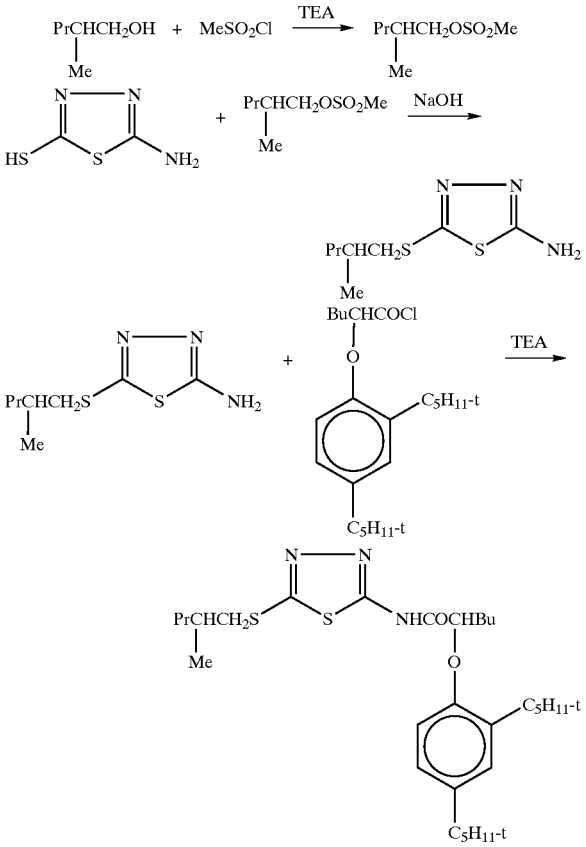

2-Methylpentyl Methanesulphonate

A 5-L three-necked round bottom flask was charged with 2-methylpentanol (408.2 g, 4 mol, Aldrich). Dichloromethane (2.5 L) and triethylamine (606 g, 6 mol, Fisons) were added. The solution was cooled in an ice-acetone bath to ca. 0° C. and methanesulphonyl chloride (458 g, 4 mol, Aldrich) was added dropwise with stirring, keeping the internal temperature below 5° C. (addition time 6 h). A white precipitate began to form during the addition of the sulphonyl chloride. After completion of the addition the mixture was stirred at an ice-bath temperature for 30 min and then overnight at room temperature. The mixture was filtered to remove the triethylamine hydrochloride and the filtrate was washed with 1) 10% HCl (2.5 L); 2) saturated sodium bicarbonate solution (2.5 L) and then 3) brine (2.5 L). The filtrate was then dried (MgSO4) and concentrated to give a pale orange oil that was distilled under reduced pressure (0.05 mm Hg) to give F1 Colorless liquid bp 32–88° C. wt 33.1 g F2 Colorless liquid bp 88–95° C. wt 41.4 g F3 Very pale yellow liquid bp 95–103° C. wt 600 g;

Analysis showed that F1 contained the starting alcohol and that F2 and F3 were pure product. Total yield 641.4 g; 89%.

This reaction has been successfully carried out using toluene as the solvent instead of dichloromethane.

2-(2-Methylpentylthio)-1,3,4-thiadiazole-5-amine

A three-necked 3-L round bottom flask was charged with 2-methylpentyl methanesulphonate (90 g, 0.5 mol), ethanol (1.5 L) and 2-mercapto-1,3,4-thiadiazole-5-amine (66.5 g, 0.5 mol). Sodium hydroxide (20 g, 0.5 mol) was added to the stirred suspension. The mixture was heated to reflux and held at reflux over night. As the mixture warmed the cream suspension gradually dissolved. Just before refluxing began a cloudy precipitate formed. The reaction mixture was cooled to room temperature, filtered, and the residue was washed well with ethanol. The resulting filtrate was concentrated to dryness to give an off-white solid that was dissolved in ethyl acetate (1.2 L) and washed with 1) water (800 mL) and 2) brine (1 L). The filtrate was dried ($MgSO_4$) and concentrated to dryness. An off-white solid was obtained that was recrystallised from boiling acetonitrile (150 mL). The filtered material was washed well with acetonitrile and dried (Vac/40° C.). The required product was obtained as a white solid wt 83 g; 76.5%.

This reaction has been carried out successfully in isopropanol as solvent instead of ethanol.

COMPOUND AK

A 2-L 3-necked round bottom flask was charged with 5-2-methylpentylthio)-1,3,4-thiadiazol-2-ylamine (81.6 g, 0.376 mol), triethylamine (57 g, 0.564 mol), and ethyl acetate (200 mL). A solution of 2-(2,4-di-t-pentylphenoxy) hexanoyl chloride (137.8 g, 0.376 mol) in ethyl acetate (400 mL) was added dropwise with stirring. Cooling was used (ice-bath) and the internal temperature did not exceed 40° C. A precipitate formed about a third of the way through the addition. The mixture was stirred overnight at room temperature. The mixture was filtered to remove the triethylamine hydrochloride. The filtrate was washed with 1)10% HCl (1.5 L), 2) and brine (1.5 L). The filtrate was dried ($MgSO_4$) and concentrated to dryness. An orange oil was obtained that was dissolved in boiling methanol (500 mL) and decanted into a conical flask. More methanol (ca 400 mL) was added and the solution was stirred and cooled. A hard pad formed at the bottom of the flask with some loose product. The supernatant liquor was decanted and saved and the hard pad was removed, broken up, and ground in a mortar. All the product was returned to the conical flask and the liquor was re-added. The mixture was stirred overnight at room temperature. The mixture was filtered and washed with methanol, dried (vac./40° C.) and the required product was obtained as a white solid wt 161.61 g; 78.5%.

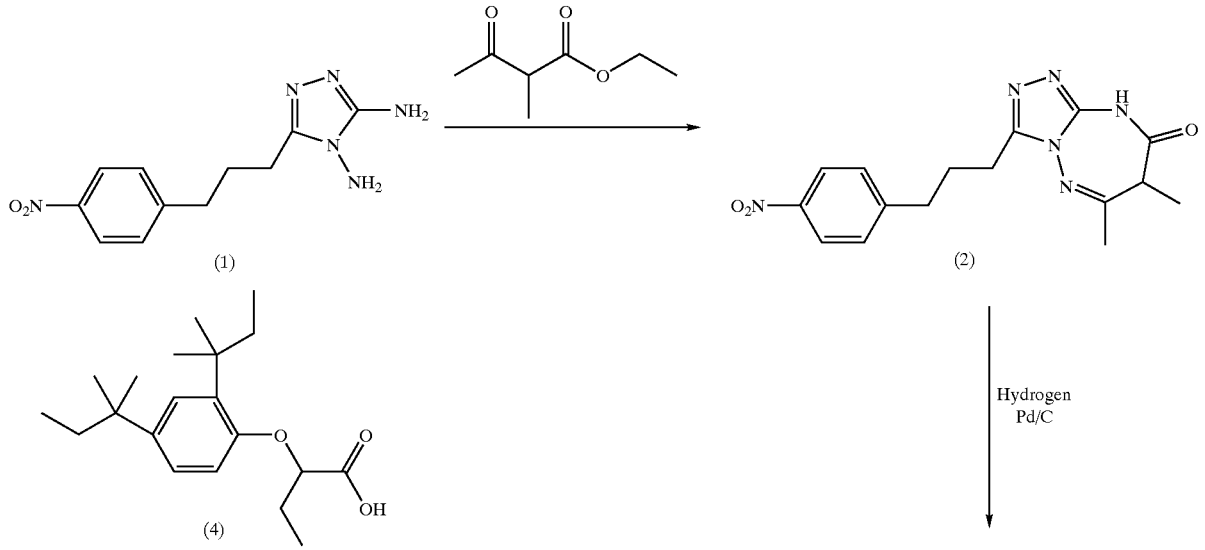

-continued
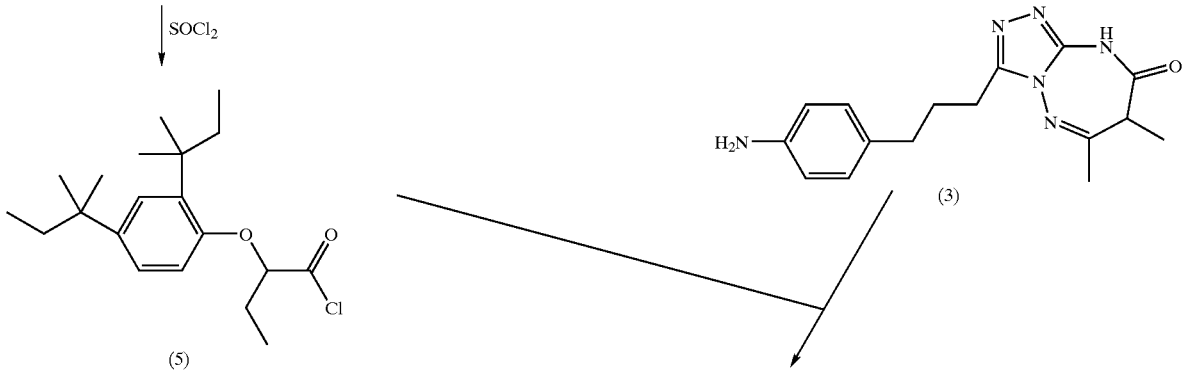
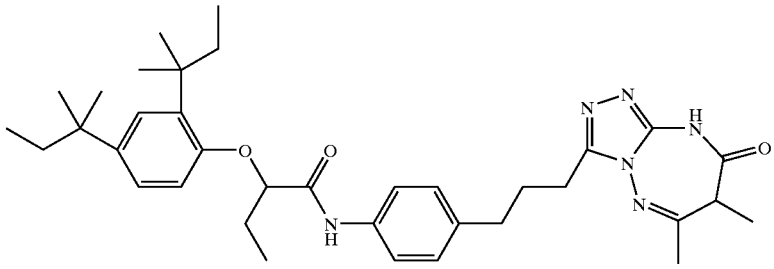
AK
AS
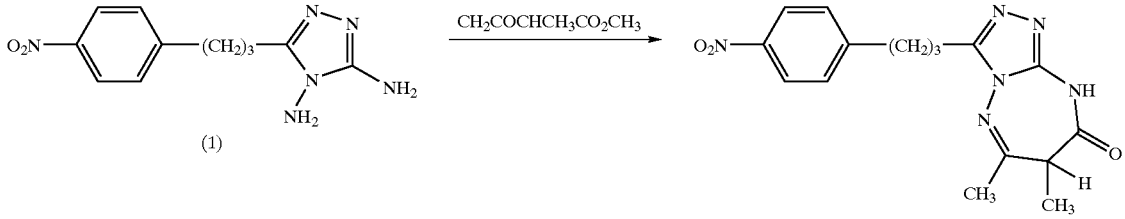
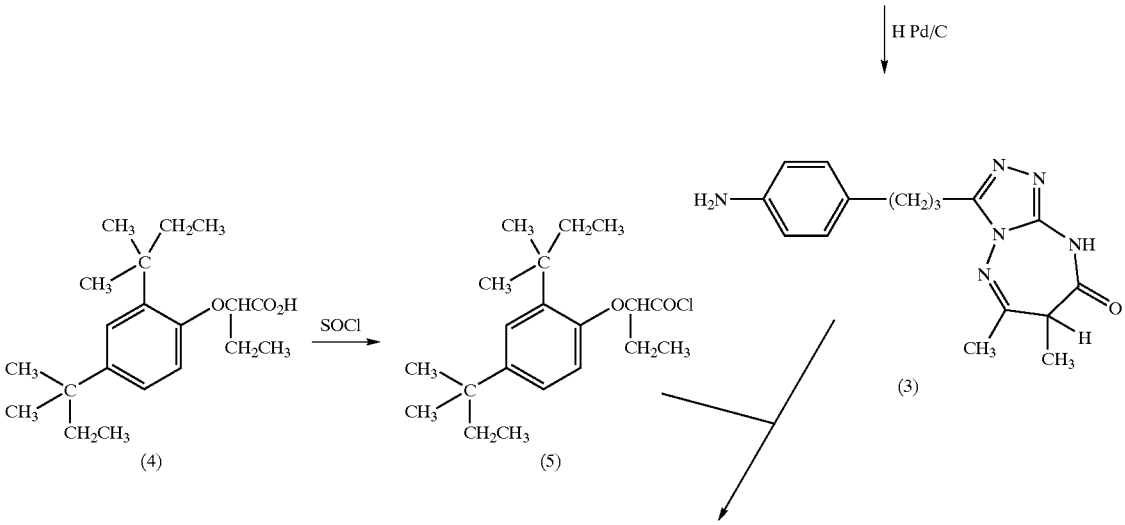

-continued

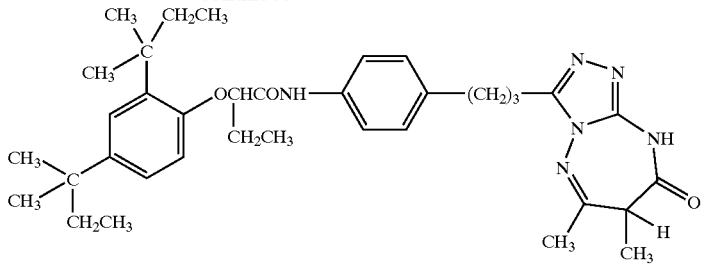

AS

Intermediate (2)

Compound (1) (40 g, 0.153 mol) and methyl acetoacetate (51.0 g, 0.44 mol) were slurried in a mixture of xylene (200 mL) and glacial acetic acid (10 mL). The mixture was heated to 140° C. (yellow solution formed quickly) and stirred overnight. The mixture was allowed to cool to room temperature and a yellow, crystalline solid was noted. The volume of solvent was substantially reduced (to ca. 75 mL) on the rotary evaporator and the residue was cooled in ice. The yellow precipitate was filtered and washed with fresh xylene. The product was dried at the pump for 1 h, air dried overnight and then in the vacuum oven for 3 h. Yield 39.9 g (80%)

Amine (3)

Intermediate (2) (10.0 g, 0.03 mol) was slurried in a mixture of tetrahydrofuran (300 mL) and dimethylacetamide (200 mL) and stirred magnetically for 20 min. Palladium on carbon catalyst (10%) (3.0 g) was added and the mixture was hydrogenated overnight at 25 atm pressure. The mixture was filtered through a bed of Kieselguhr and the solvent was removed on the rotary evaporator. Diethyl ether (100 mL) was added to the residual oil and the mixture was allowed to stand over the weekend. The oil had solidified and this was filtered and washed with ether. The product was dried in the vacuum oven. Yield 8.5 g (95%)

Acid Chloride (5)

Acid (4) (5.91 g, 0.018 mol) was dissolved in a mixture of dichloromethane (100 mL), thionyl chloride (100 mL) and 2–3 drops of dimethylformamide and heated to reflux in an oil bath for 2.5 h at 100° C. The reaction mixture was allowed to cool and left overnight. Volatiles were removed under vacuum and then, to remove residual thionyl chloride, the oil was taken up into dry dichloromethane (3×200 mL) that was then removed on the rotary evaporator to leave a yellow oil which was used immediately in the next stage.

Compound AS

Amine (3) (5.0 g, 0.0167mol) and triethylamine (2.5 mL, 0.017 mol) were dissolved in dry tetrahydrofuran (200 mL) by warming on a steam bath. A solution of the acid chloride (5) (0.018 mol) in dry tetrahydrofuran (70 mL) was added slowly with stirring as the mixture was cooled in an ice/acetone bath. The reaction was left standing at room temperature overnight. The volume of solvent was reduced on the rotary evaporator and the residue was poured into a mixture of ice/water (2.0 L) and concentrated hydrochloric acid (20 mL). The mixture was stirred for 2 h and the solid product was filtered, washed with water and air-dried. The white solid was dissolved in a mixture of petroleum ether (750 mL) and ethyl acetate (100 mL) and the solution was refrigerated over the weekend. The precipitate was filtered and washed with petrol. The product was further purified by recrystallization from a mixture of petroleum ether (750 mL) and ethyl acetate (65 mL). The white solid was filtered, air dried and then dried in a vacuum desiccator overnight. Yield 6.27 g (62.5%).

Photographic Examples

Multilayer films demonstrating the principles of this invention were produced by coating the following layers on a cellulose triacetate film support (coverage are in grams per meter squared, emulsion sizes as determined by the disc centrifuge method and are reported in diameter×thickness in micrometers). Surfactants, coating aids, emulsion addenda (including 4-hydroxy-6-methyl-1,3,3a,7-tetraazaindene), sequestrants, thickeners, lubricants, matte and tinting dyes were added to the appropriate layers as is common in the art.

Sample ML-1:

Layer 1 (Antihalation layer): gelatin at 1.08, colloidal gray silver at 0.150; ILS-1 at 0.097; DYE-1 at 0.029; DYE-2 at 0.065; DYE-3 at 0.021; CH-1 at 0.025 and UV-1 at 0.075.

Layer 2 (Slow cyan layer): a blend of two red-sensitized (all with a mixture of RSD-1 and RSD-2) tabular silver iodobromide emulsions: (i) 0.81×0.11 μm, 4.5 mol % I at 0.400, (ii) 0.62×0.111 μm, 4.1 mol % iodide at 0.175; cyan dye-forming couplers C-1 at 0.248 and C-2 at 0.236; bleach accelerator releasing coupler B-1 at 0.086; image modifier DIR-1 at 0.032; OxDS-1 at 0.010 and gelatin at 1.08.

Layer 3 (Mid cyan layer): a red-sensitized (with a mixture of RSD-1 and RSD-2) iodobromide tabular emulsion (1.44×0.13 μm, 3.7 mol % I) at 0.572; C-1 at 0.265; C-2 at 0.103; B-1 at 0.011; DIR-2 at 0.043; masking coupler MC-1 at 0.022 and gelatin at 1.08.

Layer 4 (Fast cyan layer): a red-sensitized (with a mixture of RSD-1, RSD-2 and RSD-3) iodobromide tabular emulsion (2.41×0.13 μm, 3.7 mol % I) at 1.286; C-1 at 0.163; DIR-2 at 0.0.054; B-1 at 0.008 and gelatin at 1.08.

Layer 5 (Ultra-fast cyan layer): a red-sensitized (with a mixture of RSD-1, RSD-2 and RSD-3) iodobromide tabular emulsion (3.87×0.13 μm, 3.7 mol % 1) at 1.180; C-2 at 0.175; DIR-3 at 0.060; DIR4 at 0.001 and gelatin at 1.08.

Layer 6 (Interlayer): ILS-1 at 0.075 and gelatin at 1.08.

Layer 7 (Slow magenta layer): a blend of two green-sensitized (both with a mixture of GSD-1 and GSD-2) silver iodobromide tabular emulsions: (i) 1.17×0.12 μm, 4.5 mol % iodide at 0.156 and (ii) 0.62×0.111 μm, 2.6 mol % iodide at 0.573; magenta dye-forming coupler M-1 at 0.300; MC-2 at 0.090, DIR-5 at 0.032, ILS-1 at 0.011 and gelatin at 1.400.

Layer 8 (Mid magenta layer): a blend of two green-sensitized (both with a mixture of GSD-1 and GSD-2) silver iodobromide tabular emulsions: (i) 2.46×0.13 μm, 3.7 mol % iodide at 0.534 and (ii) 1.45×0.13 μm, 3.7 mol % iodide at 0.370; M-1 at 0.089; MC-2 at 0.086; DIR-5 at 0.025, ILS-1 at 0.012 and gelatin at 1.438.

Layer 9 (Fast magenta layer): two parts mixed together at a 1:1 ratio just prior to coating;

Part A (dispersion melt): M-1 at 0.104; DIR-5 at 0.011; ILS-1 at 0.014 and gelatin at 0.420 and Part B (emulsion melt): a green-sensitized (with a mixture of GSD-1 and GSD-2) silver iodobromide tabular emulsion (2.90×0.13 μm, 3.7 mol % iodide) at 1.240; MC-2 at 0.021; DIR-6 at 0.003 and gelatin at 1.076. In some examples as noted, both parts were mixed together and stirred for at least 1 hr before coating.

Layer 10 (Interlayer): ILS-1 at 0.182 and gelatin at 0.700.

Layer 11 (Slow yellow layer): a blend of three blue-sensitized (all with BSD-1 and BSD-2) tabular silver iodobromide emulsions (i) 2.41×0.1 μm, 2.0 mol % I at 0.402, (ii) 1.02×0.137 μm, 2.0 mol % I at 0.136, (iii) 0.62×0.111 μm, 2.6 mol % I at 0.505; yellow dye forming coupler Y-1 at 0.850; DIR-1 at 0.022; DIR-7 at 0.038; B-1 at 0.009 and gelatin at 1.90.

Layer 12 (Fast yellow layer): a blue-sensitized (with BSD-1 and BSD-2) tabular silver iodobromide emulsion, 3.72×0.131 μm, 3.7 mol % I at 0.070 and a blue-sensitized (with BSD-1) 3-D silver iodobromide emulsion, 1.21 μm diameter), 9.7 mol % I at 1.055; Y-1 at 0.312; DIR-7 at 0.065; B-1 at 0.011, stabiliser S-1 at 0.008 and gelatin at 1.280.

Layer 13 (UV Filter Layer): silver bromide Lippmann emulsion at 0.215; UV-1 and UV-2 both at 0.108 and gelatin at 0.700.

Layer 14 (Protective overcoat): gelatin at 0.888 and bis(vinylsulfonyl)methane hardener at 1.75% of total gelatin weight.

All comparative and inventive heterocycles were dispersed in twice their own weight in N,N-dibutyllauramide unless otherwise noted. All parts containing the comparative or inventive heterocycles were stirred at 40 deg C. for at least 1 h before coating.

The coupling-off group for DIR-7, 5-phenoxycarbonylbenzotriazole, may be prepared as follows

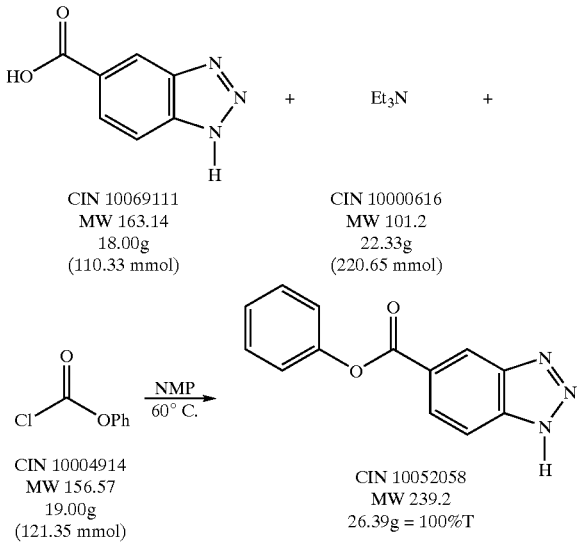

A vessel is charged with carboxybenzotriazole, 1-methyl-2-pyrrolidinone, and triethylamine. The mixture is heated to 60° C. and phenyl chloroformate added slowly. The reaction is stirred at 60° C. for 2 h as 5-phenoxycarbonylbenzotriazole is formed in >90% conversion. The reaction mixture is cooled to 45° C., quenched with hot water and acidified to pH 3–4 with concentrated HCl. The crude product is isolated by filtration. This crude is then recrystallized from methanol and dried to afford the desired product in >80% yield and >99% assay.

This reaction can be carried out in various aprotic solvents such as DMF, DMAc, toluene, ethyl and propyl acetate, acetonitrile, butyronitrile or pPropionitrile. Several bases (organic and inorganic) have proven to be effective in this conversion. Bases employed were DBU, TMG, DABCO, sodium and potassium carbonate, as well as sodium and potassium bicarbonate. The conversion from carboxylic acid to ester can be accomplished using any appropriate chloroformate such as alkyl, aryl and substituted aryl chloroformates. Methylchloroforrnate, ethylchloroformate, 4-nitrophenyl chloroformate, 4-methyoxyphenyl chloroformate and 4-methylphenyl chloroformate have all been shown to form the corresponding esters when reacted with carboxylic acids. This chemistry is not substrate specific but can be applied to various types of carboxylic acids.

Comparative sample ML-2-A had N,N-dibutyllauramnide at 58.0 added to Part A of Layer 9 and in ML-2-C, it was added to Part B of Layer 9. ML-2-B was where Parts A and B were combined together with N,N-dibutyllauramide at the same level.

Comparative sample ML-3-A had CH-1 at 0.0806 mmol/$m^2$ added to Part A only of Layer 9. ML-3-B was where Parts A and B were combined together with CH-1 at the same level. ML-3-C had CH-1 at 0.0806 mmol/$m^2$ added to Part B only of Layer 9. Note that CH-1 is identical to compound X of U.S. Pat. No. 6,319,660.

Comparative sample ML-4-A had CH-2 at 0.0806 mmol/$m^2$ added to Part A of Layer 9. ML-4-B was where Parts A and B were combined together with CH-2 at the same level. Note that CH-2 is identical to compound BJ of U.S. Pat. No. 6,319,660.

Comparative sample ML-5-A had CH-3 at 0.0806 mmol/$m^2$ added to Part A of Layer 9. ML-5-B was where Parts A and B were combined together with CH-3 at the same level.

Comparative sample ML-6-A had CH-4 at 0.0806 mmol/$m^2$ added to Part A of Layer 9. ML-6-B was where Parts A and B were combined together with CH-4 at the same level.

Comparative sample ML-7-A had CH-5 at 0.0806 mmol/$m^2$ added to Part A of Layer 9. ML-7-B was where Parts A and B were combined together with CH-1 at the same level.

Comparative sample ML-8-B was where Parts A and B were combined together with CH-6 at 0.0806 mmol/$m^2$. Note that CH-6 is identical to compound BI of U.S. Pat. No. 6,319,660.

Inventive sample ML-9-A had Compound BY at 0.0806 mmol/$m^2$ added to Part A of Layer 9. ML-9-B was where Parts A and B were combined together with Compound BY at the same level.

Inventive sample ML-10-A had Compound BB at 0.0806 mmol/$m^2$ added to Part A of Layer 9. ML-10-B was where Parts A and B were combined together with Compound BB at the same level.

For comparative and inventive samples ML-11 to ML-41, 0.0806 mmol/$m^2$ (except for Compound AD that was at 0.0765 mmol/$m^2$ and Compound D that was at 0.0749 mmol/$m^2$) of the comparative or inventive heterocycle was added to either Part A or B of Layer 9 as noted.

Formulas for materials used in the above formats are as follows:

ILS-1:
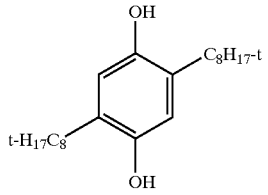
DYE-1:
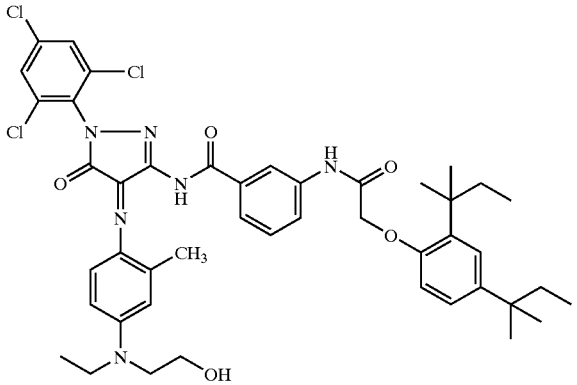
DYE-2:
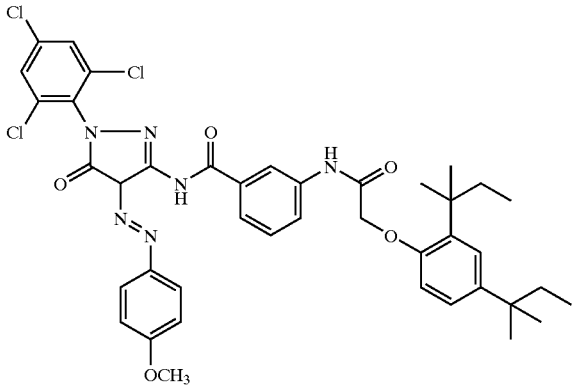
DYE-3:
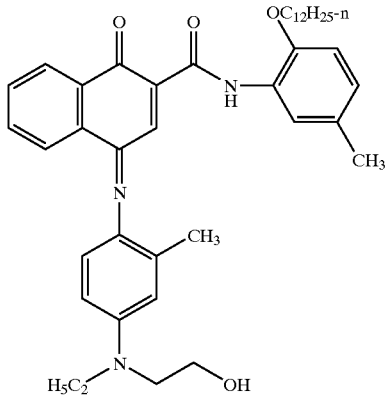
UV-1:
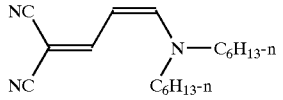
-continued
C-1:
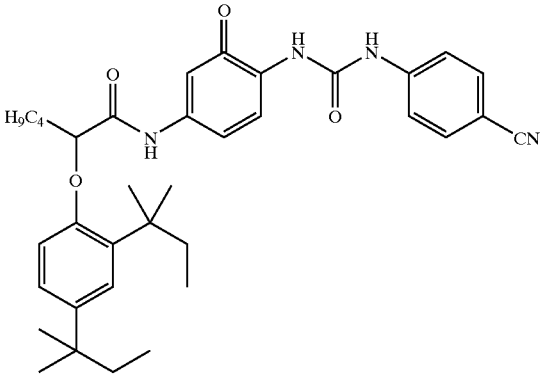
C-2:
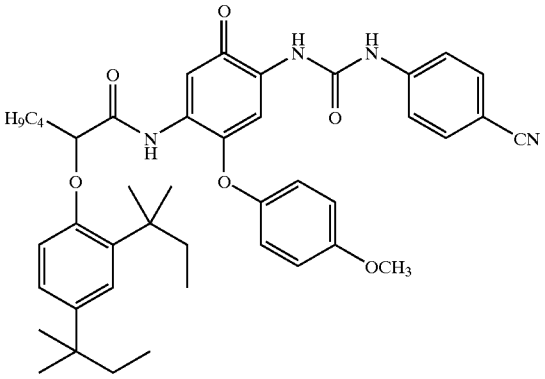
B-1:
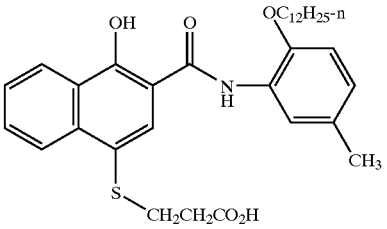
DIR-1:
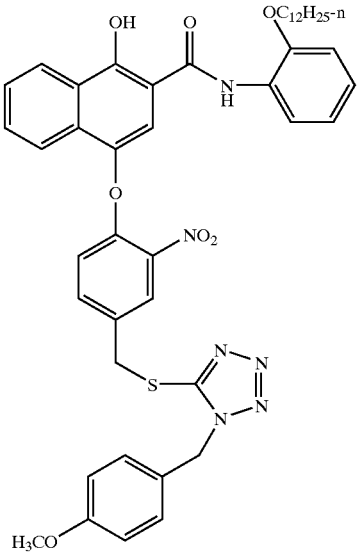

-continued
OxDS-1:
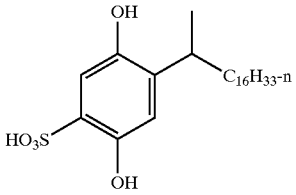
DIR-2:
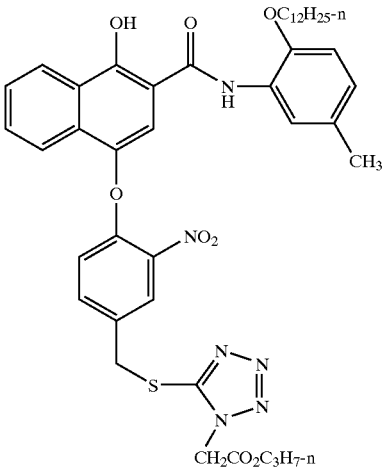
MC-1:
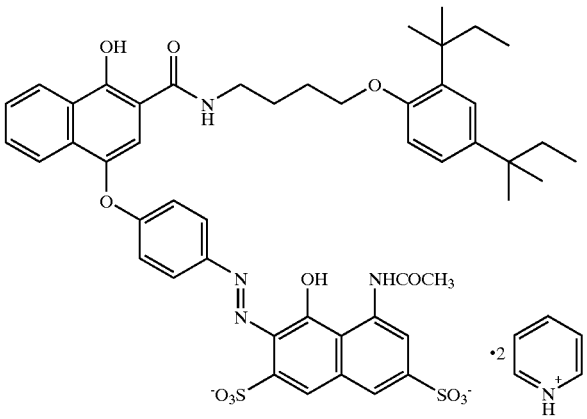
DIR-3:
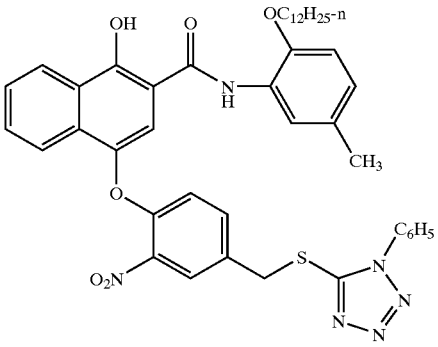
-continued
DIR-4:
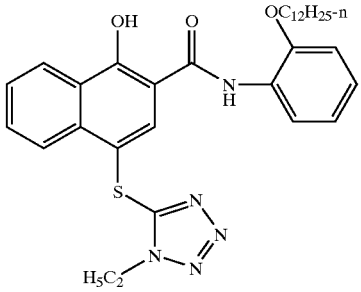
M-1:
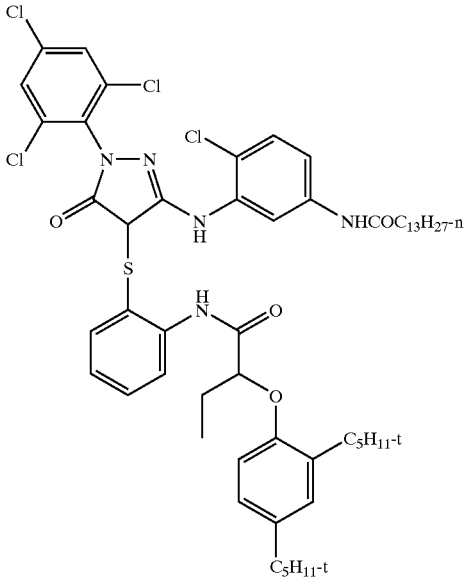
M-2:
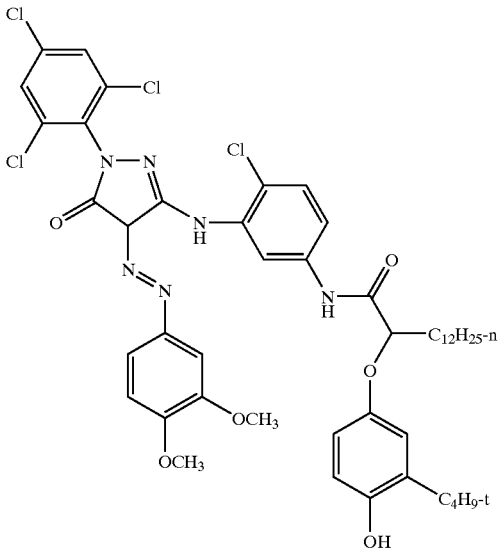

-continued
DIR-5:
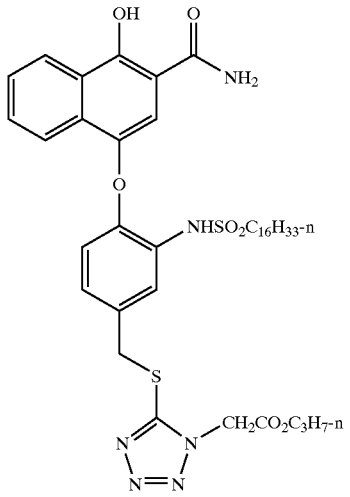
DIR-6:
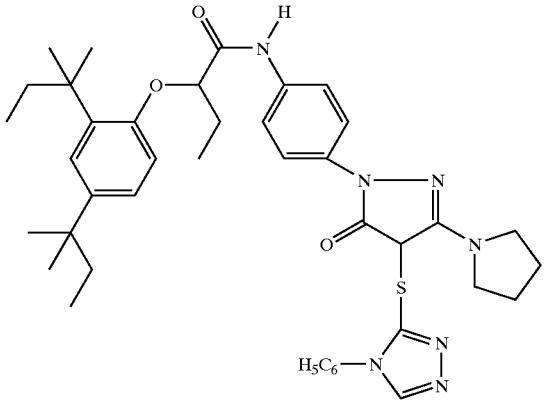
Y-1:
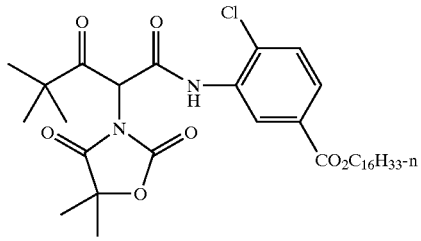
DIR-7:
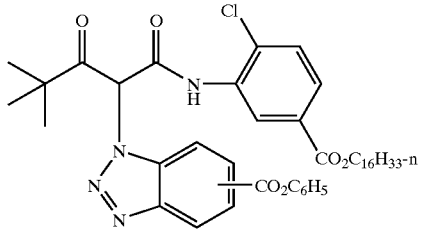
-continued
S-1:
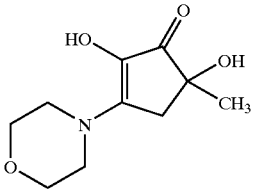
UV-2:
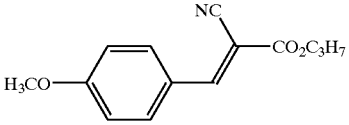
BSD-1:
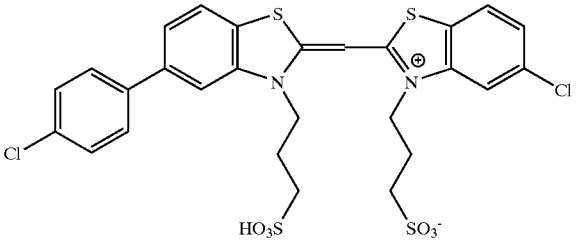
BSD-2:
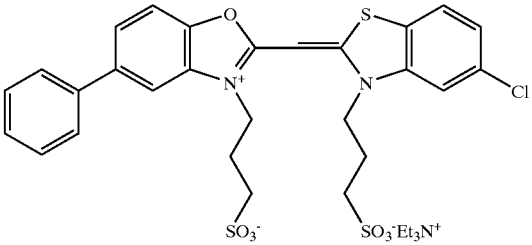
GSD-1:
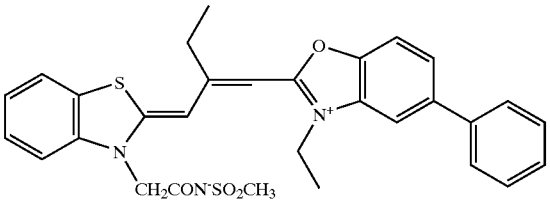
GSD-2:
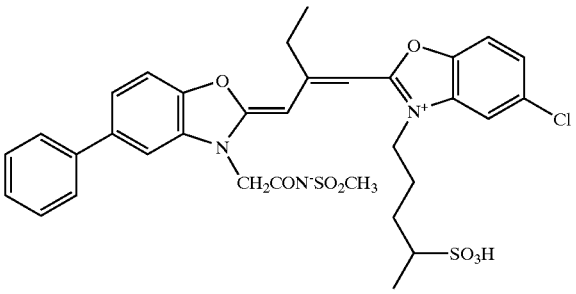

-continued

RSD-1:

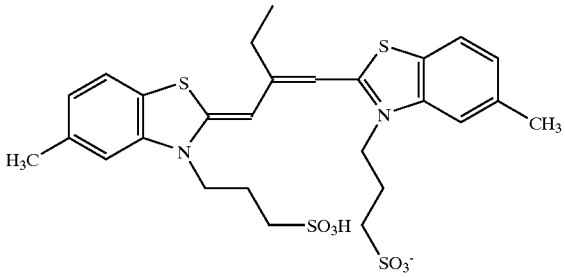

RSD-2:

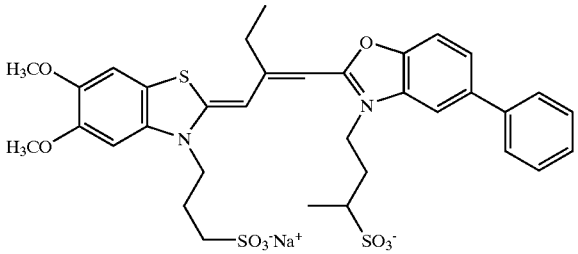

RSD-3:

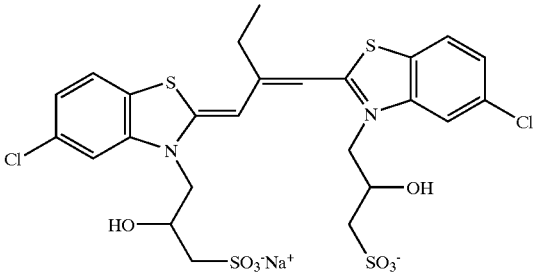

The structures of the comparative heterocycles (along with Log Kow) are as follows:

CH-1:
(7.01)

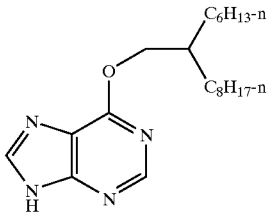

CH-2:
(8.36)

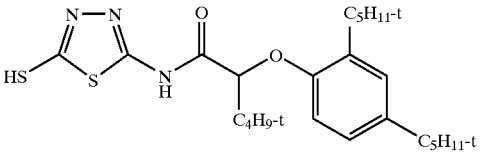

CH-3:
(7.38)

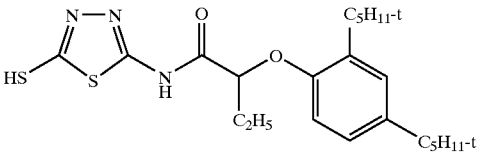

-continued

CH-4:
(10.00)

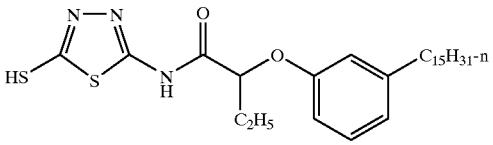

CH-5:
(8.68)

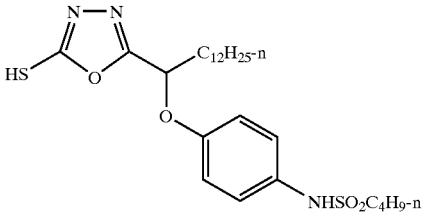

CH-6:
(8.88)

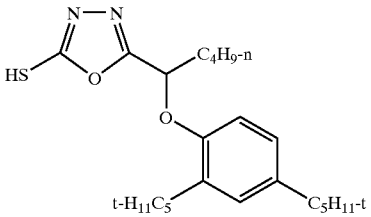

CH-7:
(0.94)

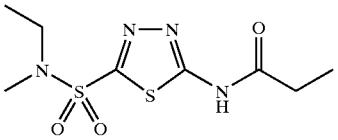

CH-8:
(4.93)

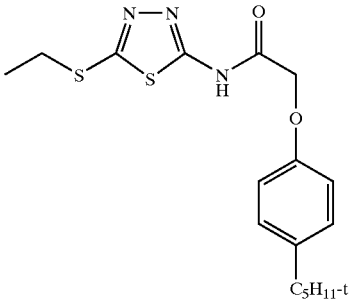

CH-9:
(5.34)

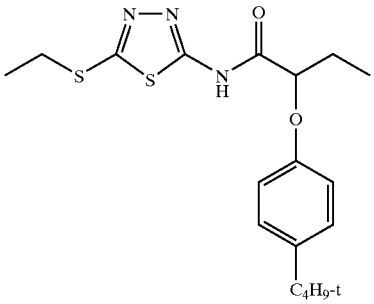

To determine speed these multilayer coatings were given a stepped neutral exposure and processed in the KODAK FLEXICOLOR™ (C41) process as described in *British Journal of Photography Annual*, 1988, pp 196–198. Relative speed or light sensitivity (given in terms of fraction of a stop) was determined by comparing the exposure point +0.15 green density units above green Dmin to the check position without any heterocycle. A larger, more positive number means increased speed; a negative number means a loss in speed. To determine interimage, these multilayer coatings were given a stepped exposure in the red record while the green and blue layers were simultaneously given an uniform, nonimagewise flash exposure so that the green density ($G_{minR}$) where there was no red record development (minimum red exposure point) was close to 1.0. Then, a red exposure point was determined that was 0.6 logE units less than the point that was 0.15 red density units above red Dmin. The green density ($G_R$) was read at this red exposure point. Interimage is the difference in green density $G_R$—$G_{minR}$ and represents the decrease in green layer development as a function of red exposure. Delta Interimage is the difference in interimage between the sample containing the heterocycle and the check sample without any heterocycle. A more negative number reflects a greater loss in green density and hence, an increase in red-onto-green interimage. Results are shown in Table 1.

TABLE 1

Speed Heterocycles in Multilayer Format

| Sample | Comp/Inv | Addenda | Layer 9[a] | Speed | Delta Interimage |
|---|---|---|---|---|---|
| ML-1-A | Comp | None | A | Check | Check |
| ML-1-B | Comp | None | A + B | −0.20 | −0.004 |
| ML-2-A | Comp | N,N-Dibutyl-lauramide | A | +0.06 | −0.003 |
| ML-2-B | Comp | N,N-Dibutyl-lauramide | A + B | −0.10 | +0.001 |
| ML-2-C | Comp | N,N-Dibutyl-lauramide | B | +0.06 | −0.006 |
| ML-3-A | Comp | CH-1 | A | +0.40 | +0.035 |
| ML-3-B | Comp | " | A + B | −0.60 | +0.015 |
| ML-3-C | Comp | " | B | −0.47 | −0.006 |
| ML-4-A | Comp | CH-2 | A | +0.20 | +0.015 |
| ML-4-B | Comp | " | A + B | −0.53 | +0.015 |
| ML-5-A | Comp | CH-3 | A | +0.17 | +0.017 |
| ML-5-B | Comp | " | A + B | −0.53 | +0.015 |
| ML-6-A | Comp | CH-4 | A | +0.13 | +0.015 |
| ML-6-B | Comp | " | A + B | −0.97 | +0.020 |
| ML-7-A | Comp | CH-5 | A | +0.37 | +0.022 |
| ML-7-B | Comp | " | A + B | −0.43 | +0.031 |
| ML-8-B | Comp | CH-6 | A + B | −0.27 | +0.016 |
| ML-9-A | Inv | AU | A | +0.23 | +0.010 |
| ML-9-B | Inv | " | A + B | +0.20 | +0.010 |
| ML-10-A | Inv | AG | A | +0.27 | +0.003 |
| ML-10-B | Inv | " | A + B | +0.23 | +0.005 |
| ML-11-A | Inv | AI | A | +0.45 | +0.028 |
| ML-11-B | Inv | " | B | +0.33 | +0.028 |
| ML-12-A | Inv | AM | A | +0.28 | +0.004 |
| ML-12-B | Inv | " | B | +0.27 | +0.008 |
| ML-13-A | Inv | P | A | +0.48 | +0.022 |
| ML-13-B | Inv | " | B | +0.27 | +0.015 |
| ML-14-A | Inv | AR | A | +0.40 | +0.001 |
| ML-14-B | Inv | " | B | +0.27 | +0.001 |
| ML-15-A | Inv | J | A | +0.33 | +0.003 |
| ML-15-B | Inv | " | B | +0.23 | +0.010 |
| ML-16-A | Inv | X | A | +0.28 | +0.008 |
| ML-16-B | Inv | " | B | +0.23 | +0.008 |
| ML-17-A | Inv | S | A | +0.48 | +0.016 |
| ML-17-B | Inv | " | B | +0.30 | +0.017 |
| ML-18-A | Inv | B | A | +0.45 | −0.003 |
| ML-18-B | Inv | " | B | +0.23 | −0.002 |
| ML-19 | Comp | CH-7 | A | +0.06 | +0.005 |
| ML-20 | Comp | CH-8 | A | +0.03 | −0.001 |
| ML-21 | Comp | CH-9 | A | +0.06 | +0.018 |
| ML-22 | Inv | AV | A | +0.20 | −0.003 |
| ML-23 | Inv | AE | A | +0.20 | −0.010 |
| ML-24 | Inv | AP | A | +0.27 | −0.007 |
| ML-25 | Inv | C | A | +0.27 | +0.024 |
| ML-26 | Inv | I | A | +0.33 | +0.015 |
| ML-27 | Inv | A | A | +0.42 | +0.018 |
| ML-28 | Inv | U | A | +0.42 | −0.002 |
| ML-29 | Inv | AK | A | +0.42 | +0.008 |
| ML-30 | Inv | AC | A | +0.40 | +0.029 |
| ML-31 | Inv | R | A | +0.31 | +0.005 |
| ML-32 | Inv | AA | A | +0.42 | +0.009 |

TABLE 1-continued

Speed Heterocycles in Multilayer Format

| Sample | Comp/Inv | Addenda | Layer 9[a] | Speed | Delta Interimage |
|---|---|---|---|---|---|
| ML-33 | Inv | G | A | +0.42 | +0.005 |
| ML-34 | Inv | Y | A | +0.27 | −0.011 |
| ML-35 | Inv | AL | A | +0.50 | +0.023 |
| ML-36 | Inv | AS | A | +0.50 | +0.036 |
| ML-41 | Inv | H | A | +0.20 | −0.002 |

[a]Layer 9 was coated in one of three ways. Method A means that the addendum dispersion was premixed with other dispersion materials and the mixture was added together with the light sensitive emulsion melt immediately prior to coating (dual melts). Method B means that the addendum dispersion was premixed with the emulsion melt and the mixture was added together with the other dispersion materials immediately prior to coating (also dual melts). Method A + B means that the addendum dispersion was premixed with other dispersion materials as well as the emulsion melt, and the mixture was stirred for at least 1 h at 40 degrees Centigrade prior to coating (single melt-hold).

The results in Table 1 clearly demonstrate that the improved speed heterocycles useful in the invention avoid the problems typically associated with other types of speed heterocycles. For example, purine type addenda (CH-1), mercaptothiadiazole type addenda (CH-2 to CH-5) and mercaptooxadiazole type addenda (CH-6) all give speed improvements but reduce the amount of interimage received whenever contact with the silver halide emulsions before coating is minimized (i.e. when coated in Part A of the examples) and cause speed losses if they are in contact with the silver emulsion for any significant periods of time (i.e. when coated in Part B or Part A+B of the examples). Not only do the improved speed heterocycles useful in the invention supply the desired speed increase, but they can be used in mixtures that contain silver emulsions without causing speed losses. They can also better maintain the interimage (less loss relative to the no-addenda check).

These results also demonstrate the importance of Log Kow. The comparative heterocycles CH-7, CH-8 and CH-9 with Log Kow with less than 6.4 only give speed increases (+0.03 to +0.06) similar to that of the solvent blank alone (ML-2-A). In order to obtain preferred speed, the improved speed heterocycles useful in the invention should have a Log Kow of at least 6.4 (i.e. Compound AV, Log Kow=6.82, gives a speed increase of +0.20), or more preferably of at least 7.25 or greater (i.e. Compound AP, Log Kow=7.33, gives a speed increase of +0.27), or most preferably 8.5 or greater (i.e. Compound B, Log Kow=9.05, gives a speed increase of +0.45). It is also desirable that the improved speed heterocycle have an exocyclic nitrogen bearing an acidic hydrogen (i.e. as in Compound AR in ML-14-A compared to Compound H in ML-41) for preferred speed effect.

The entire contents of the patents and other publications referred to in this specification are incorporated herein by reference.

What is claimed is:

1. A color photographic element comprising at least one light sensitive silver halide emulsion layer containing a compound that does not react with oxidized developer, has a Log Kow high enough to improve speed, compared to the same layer without the compound, and comprises (1) a thiadiazole, or (2) an oxadiazole, or (3) a 1,2,4 triazole bearing an amido substituent, and, for each compound, does not contain a hydroxyl or thiol group or their tautomeric equivalents on the azole ring.

2. The color photographic element of claim 1 in which the compound is a thiadiazole.

3. The color photographic element of claim 1 in which the compound is an oxadiazole.

4. The color photographic element of claim 1 in which the compound is a 1,2,4 triazole bearing an amido substituent.

5. The color photographic element of claim 1 in which the light sensitive layer is the most light sensitive of two or more light sensitive layers of the same color.

6. The color photographic element of claim 1 in which the compound has a Log Kow of 6.4 or greater.

7. The color photographic element of claim 1 in which the compound has a Log Kow of 8.5 or greater.

8. The color photographic element of claim 1 in which the amount of the compound in the film is sufficient to improve the speed by 0.10 stop versus no compound.

9. The color photographic element of claim 1 in which the amount of the compound in the film is sufficient to improve the speed by 0.20 stop versus no compound.

10. The color photographic element of claim 1 in which the emulsion is primarily silver iodobromide.

11. The color photographic element of claim 10 in which the light sensitive layer is the most light sensitive of two or more light sensitive layers of the same color.

12. The color photographic element of claim 11 in which the most light sensitive layer has maximum spectral sensitivity with wavelength between 500 and 600 nm.

13. The color photographic element of claim 11 in which the most light sensitive layer has maximum spectral sensitivity with wavelength between 600 and 700 nm.

14. The color photographic element of claim 11 in which the compound has a Log Kow of 8.5 or greater.

15. The color photographic element of claim 3 in which the oxadiazole is represented by Formula II:

II

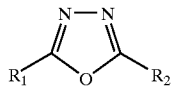

where $R_1$ and $R_2$ are independently chosen from the group consisting of hydrogen, and alkyl, aryl, oxo, thio, amino, amido, sulfinyl, sulfonyl, cyano, acyloxy, fluoro, chloro, bromo, iodo, carbonyl, carbamoyl, oxycarbonyl, and hetero-aryl groups.

16. The color photographic element of claim 15 in which $R_1$ is hydrogen or an alkyl or alkylthio group and $R_2$ is connected to the heterocycle with an acylamino group as represented in Formula III:

III

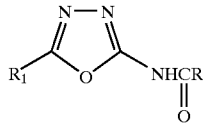

wherein R is an alkyl or aryl group.

17. The color photographic element of claim 4 in which the compound has a Log Kow of 6.4 or greater.

18. The color photographic element of claim 17 in which the compound has a Log Kow of 8.5 or greater.

19. The color photographic element of claim 17 in which the 1,2,4triazole is represented by Formula I-a:

I-a

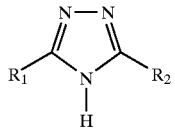

where $R_1$ is an alkylthio or alkyl group and $R_2$ is an amido group.

20. The color photographic element of claim 17 in which the 1,2,4-triazole is represented by Formula I-b I-b

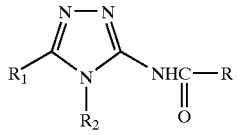

where $R_1$ is hydrogen or an alkyl or alkylthio group, $R_2$ is hydrogen or an alkyl group, R is an alkyl or aryl group, and in which $R_1$ and $R_2$, or $R_2$ and R may optionally be connected to form a nonaromatic ring.

21. The color photographic element of claim 2 in which the compound is a thiadiazole having a Log Kow of 6.4 or greater.

22. The color photographic element of claim 2 in which the compound is a thiadiazole having a Log Kow of 8.5 or greater.

23. The color photographic element of claim 21 in which the thiadiazole is represented by Formula IV:

IV

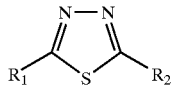

where $R_1$ and $R_2$ are independently chosen from the group consisting of hydrogen and an alkyl, aryl, oxy, thio, amino, sulfinyl, sulfonyl, amido, cyano, fluoro, chloro, bromo, iodo, carbonyl, carbamoyl, acyloxy, oxycarbonyl, or hetero-aryl group.

24. The color photographic element of claim 23 where $R_1$ is an alkylthio or alkyl group and $R_2$ is an amido group.

25. The color photographic element of claim 23 represented in Formula V:

V

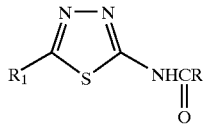

wherein $R_1$ is hydrogen or an alkyl or alkylthio group and R is an alkyl or aryl group.

26. The color photographic element of claim 25 in which the thiadiazole is represented by Formula VI:

VI

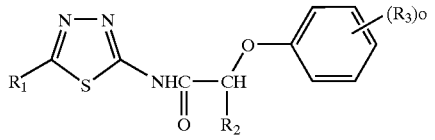

where $R_1$ is hydrogen or an alkyl or alkylthio group, $R_2$ is hydrogen or an alkyl group, $R_3$ is an alkyl group branched at the point of attachment, and n is one or two.

27. The color photographic element of claim 25 in which the emulsion is silver iodobromide, the light sensitive layer is the most light sensitive of two or more light sensitive layers of the same color, and the compound Log Kow is 8.5 or greater.

28. The color photographic element of claim 27 in which the compound is selected from the following:

BV

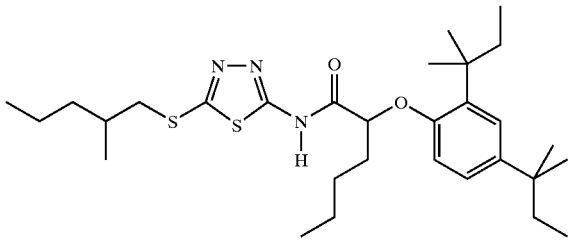

D

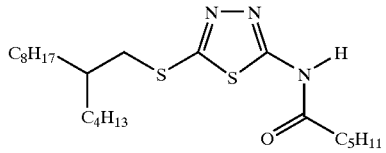

V

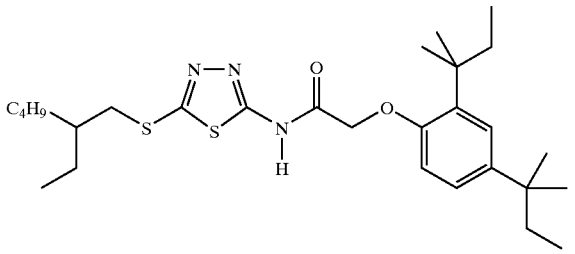

AQ

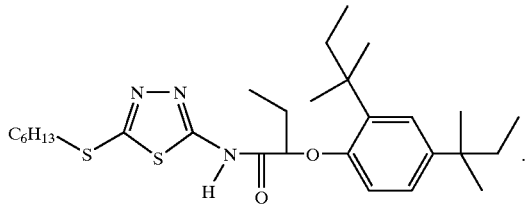

29. The color photographic element of claim 25 wherein $R_1$ and $R_2$ are groups such that the compound comprises one or more propyl groups or the fragment:

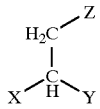

wherein X, Y, and Z are independently selected substituents.

30. The color photographic element of claim 1 wherein the compound comprises at least 14 carbon atoms.

31. A color photographic element comprising at least one light sensitive silver halide emulsion layer containing a compound that does not react with oxidized developer, has a Log Kow of at least 6.4, and comprises (1) a thiadiazole, or (2) an oxadiazole, or (3) a 1,2,4 triazole bearing an amido substituent, and, for each compound, does not contain a hydroxyl or thiol group or their tautomeric equivalents on the azole ring.

32. The color photographic element of claim 31 in which the emulsion is silver iodobromide.

33. The color photographic element of claim 31 in which the light sensitive layer is the most light sensitive of two or more light sensitive layers of the same color.

34. The color photographic element of claim 31 in which the most light sensitive layer has maximum spectral sensitivity with wavelength between 500 and 600 nm.

35. The color photographic element of claim 31 in which the most light sensitive layer has maximum spectral sensitivity with wavelength between 600 and 700 nm.

36. The color photographic element of claim 31 in which the compound comprises at least fourteen carbon atoms.

37. The color photographic element of claim 36 wherein the compound contains an acylamino group or ionizable NH group.

38. A color photographic element comprising at least one light sensitive silver halide emulsion layer containing a compound that does not react with oxidized developer, has a Log Kow high enough to improve speed after holding the melted silver halide emulsion layer containing the compound for one hour, compared to the same layer without the compound, and comprises (1) a thiadiazole, or (2) an oxadiazole, or (3) a 1,2,4 triazole bearing an amido substituent, and, for each compound, does not contain a hydroxyl or thiol group or their tautomeric equivalents on the azole ring.

* * * * *